US006486853B2

(12) United States Patent
Yoshinomoto et al.

(10) Patent No.: US 6,486,853 B2
(45) Date of Patent: Nov. 26, 2002

(54) CHIP ANTENNA, RADIO COMMUNICATIONS TERMINAL AND RADIO COMMUNICATIONS SYSTEM USING THE SAME AND METHOD FOR PRODUCTION OF THE SAME

(75) Inventors: Makoto Yoshinomoto, Miyazaki (JP); Hiromi Sakita, Miyazaki (JP); Kenzo Isozaki, Saito (JP); Kengo Shiiba, Miyazaki (JP); Kazuhide Goto, Miyazaki (JP); Mitsuo Kanmera, Miyazaki (JP); Masanobu Kuroki, Saito (JP); Katsumi Sasaki, Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/855,669

(22) Filed: May 16, 2001

(65) Prior Publication Data

US 2002/0033778 A1 Mar. 21, 2002

(30) Foreign Application Priority Data

| | | |
|---|---|---|
| May 18, 2000 | (JP) | 2000-146557 |
| Oct. 13, 2000 | (JP) | 2000-313178 |
| Dec. 1, 2000 | (JP) | 2000-366689 |
| Jan. 23, 2001 | (JP) | 2001-014157 |
| Jan. 23, 2001 | (JP) | 2001-014158 |

(51) Int. Cl.[7] ..... H01Q 1/36; H01Q 1/38

(52) U.S. Cl. ..... 343/895; 343/700 MS; 343/702

(58) Field of Search ..... 343/702, 700 MS, 343/895, 873; 257/678, 679, 687, 723, 724

(56) References Cited

U.S. PATENT DOCUMENTS

| | | | | |
|---|---|---|---|---|
| 5,973,651 | A * | 10/1999 | Suesada et al. | 343/752 |
| 5,977,927 | A * | 11/1999 | Mandai et al. | 343/788 |
| 6,064,351 | A * | 5/2000 | Mandai et al. | 343/873 |
| 6,181,001 | B1 * | 1/2001 | Ikefuji et al. | 257/679 |
| 6,288,680 | B1 * | 9/2001 | Tsuru et al. | 343/702 |

FOREIGN PATENT DOCUMENTS

| | | | |
|---|---|---|---|
| JP | 5-13239 | 1/1993 | H01F/17/04 |
| JP | 8-296354 | 11/1996 | H04B/5/00 |
| JP | 9-64627 | 3/1997 | H01Q/1/40 |
| JP | 9-69715 | 3/1997 | H01Q/1/36 |
| JP | 9-74309 | 3/1997 | H01Q/1/40 |
| JP | 9-223908 | 8/1997 | H01Q/1/00 |
| JP | 9-232828 | 9/1997 | H01Q/1/00 |
| JP | 10-65432 | 3/1998 | H01Q/1/38 |
| JP | 3011075 | 12/1999 | H01Q/11/08 |

* cited by examiner

*Primary Examiner*—Hoang Nguyen
(74) *Attorney, Agent, or Firm*—Wenderoth, Lind & Ponack, L.L.P.

(57) ABSTRACT

A chip antenna that is simple in structure, produces small variation in antenna characteristics between individual antennas, and requires no circuit adjustments, is excellent in productivity. The chip antenna is capable of being mounted on a circuit board, as well as a wireless terminal using the chip antenna. A method of fabricating the chip antenna. A core body is made from an insulating material in a quadrangular or circular cylinder shape. A conductor in a helical shape is mounted on the side surface of the core body. A terminal portion is provided on the core body and electrically connected with an end portion of the conductor. The width, depth, and length of the core body are within ranges of 0.5–5 mm, 0.5–5 mm, and 4–40 mm, respectively. Intrinsic volume resistance and relative dielectric constant of the material are $10^{13}\Omega\cdot m$ or above and 40 or below, respectively.

34 Claims, 14 Drawing Sheets

CHIP ANTENNA, RADIO COMMUNICATIONS TERMINAL AND RADIO COMMUNICATIONS SYSTEM USING THE SAME AND METHOD FOR PRODUCTION OF THE SAME

FIELD OF THE INVENTION

The present invention relates to a chip antenna to be mounted on a circuit board of electronic apparatus for carrying out wireless communications such as mobile communications, a wireless terminal using the same, and a method for production of the same.

BACKGROUND OF THE INVENTION

With rapid development in mobile communications, radio terminal equipment represented by mobile telephones are springing into wide use.

The development owes greatly to advancement in high-frequency integrated circuit technology and development of smaller, lighter, and higher-performance antennas. As an example of such an antenna, a helical antenna produced by forming a helical conductor on an insulating rod is disclosed in Japanese Patent Laid-open Publication No. 10-65432 (1998). Although this antenna is being used as a substitute for a whip-type (rod-shaped) antenna and contributing to the provision of a smaller and lighter antenna, it is of a type used by being projected outward from the apparatus and not of a type mountable on a circuit board.

On the other hand, surface-mountable type antennas disclosed in Japanese Patent Publication No. 3011075 and Japanese Patent Laid-open Publication No. 9-64627 (1997) are mountable on a circuit board. Here, the antenna element is produced by laminating a plurality of dielectric sheets or dielectric substrates having conductive pattern formed thereon to provide a multiple-layered member and connecting the patterns with conductors through holes made in the sheet or board thereby forming a product with a modified helical shape. These antennas are complicated in structure and require a large number of component parts and further had problems with mechanical strength, electrical performance, and environment-resistive performance. The antenna disclosed in Japanese Patent Laid-open Publication No. 9-74309 (1997) improved the surface-mounted type antenna of Japanese Patent Laid-open Publication No. 9-64627 in terms of mechanical strength and environment-resistive performance and partly improved it in terms of electrical performance. The antennas disclosed in Japanese Patent Laid-open Publication Nos. 9-223908 and 9-232828 further improve the antenna in terms of electrical performance. The basic structure of these antennas is not greatly different from that of the aforesaid Japanese Patent Laid-open Publication No. 9-64627, i.e., these are similarly produced by laminating substrates with conductor patterns printed thereon and electrically connecting the patterns. Thus, they have problems of complexity of structure, multiplicity of components, and production of variations in antenna characteristics among individual antennas leading to the requirement of circuit adjustments for absorbing the variations, and hence poor productivity of the antennas.

SUMMARY OF THE INVENTION

An object of the present invention is to provide a chip antenna that is simple in structure, demonstrates a good antenna characteristic, shows a significantly small variation in antenna characteristic between individual antennas, requires no circuit adjustments, is improved in its productivity, and is capable of being mounted on a circuit board, and a wireless terminal and a wireless communications system using the chip antenna, and a method of producing the chip antenna.

In order to achieve the above mentioned object, the antenna according to the present invention comprises:

- a core body formed of a quadrangular or circular cylinder-shaped insulating material;
- a helical conductor mounted on the surface of the core body; and
- a terminal portion disposed on the core body and electrically connected with an end of the conductor. Further, width, depth, and length of the antenna are within ranges of 0.5–5 mm, 0.5–5 mm, and 4–40 mm, respectively, and intrinsic volume resistance and relative dielectric constant of the same are $10^{13}\Omega\cdot m$ or more and 40 or below, respectively.

By virtue of the above described configuration, such a chip antenna can be realized that is simple in structure yet shows a good antenna characteristic, produces a significantly small variation in antenna characteristic between individual antennas, requires no circuit adjustments, is improved in its productivity, and is capable of being mounted on a circuit board.

Further, the present invention provides a wireless terminal and a wireless communications system using the aforementioned chip antenna and a method of manufacturing the chip antenna.

DESCRIPTION OF THE PREFERRED EMBODIMENTS

With reference to the accompanying drawings, preferred embodiments of the present invention will be described in detail.

<Embodiment 1>

Figure 1:
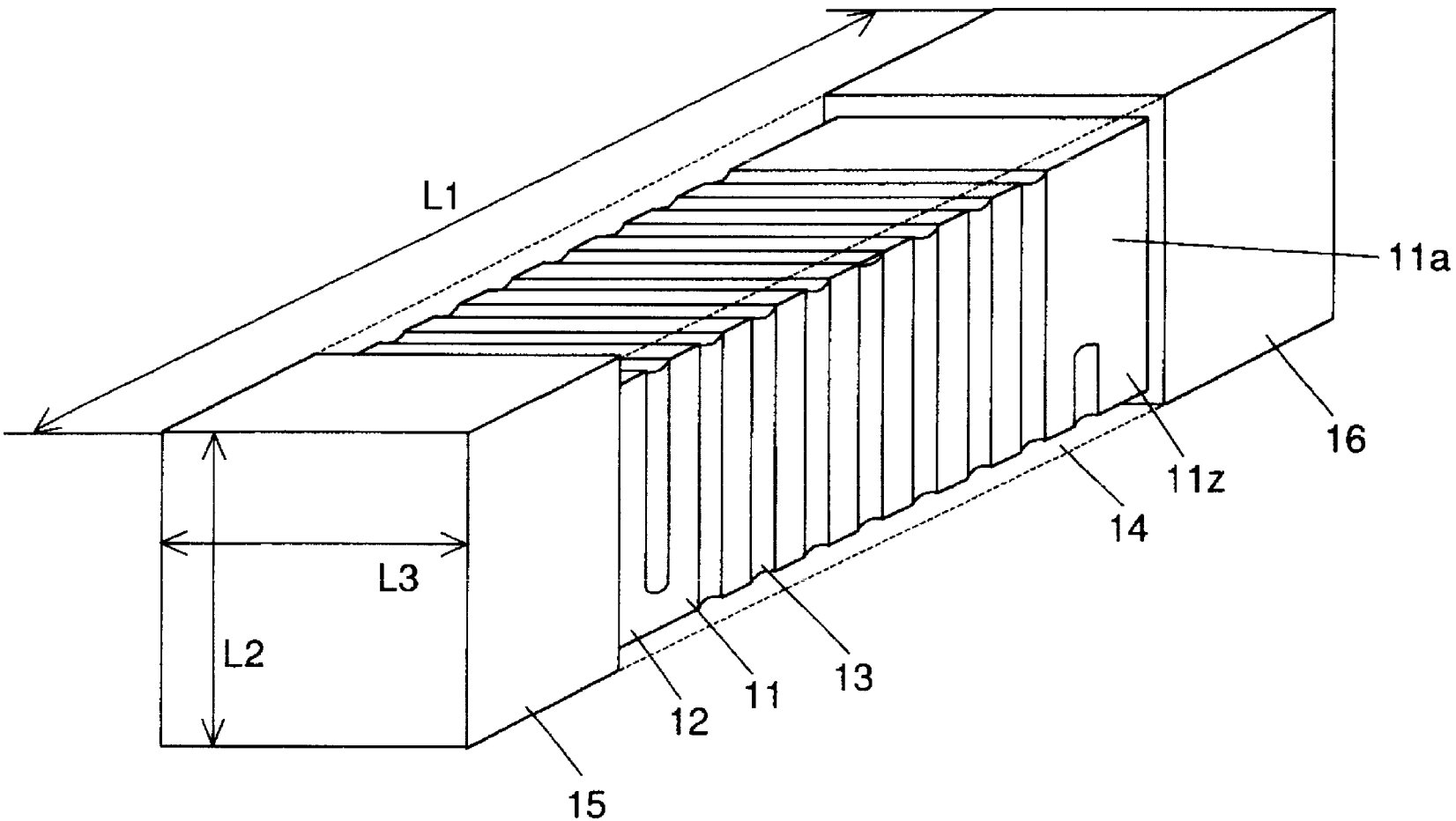
FIG. 1 is a perspective view showing a chip antenna in embodiment 1 of the invention.
Figure 2:
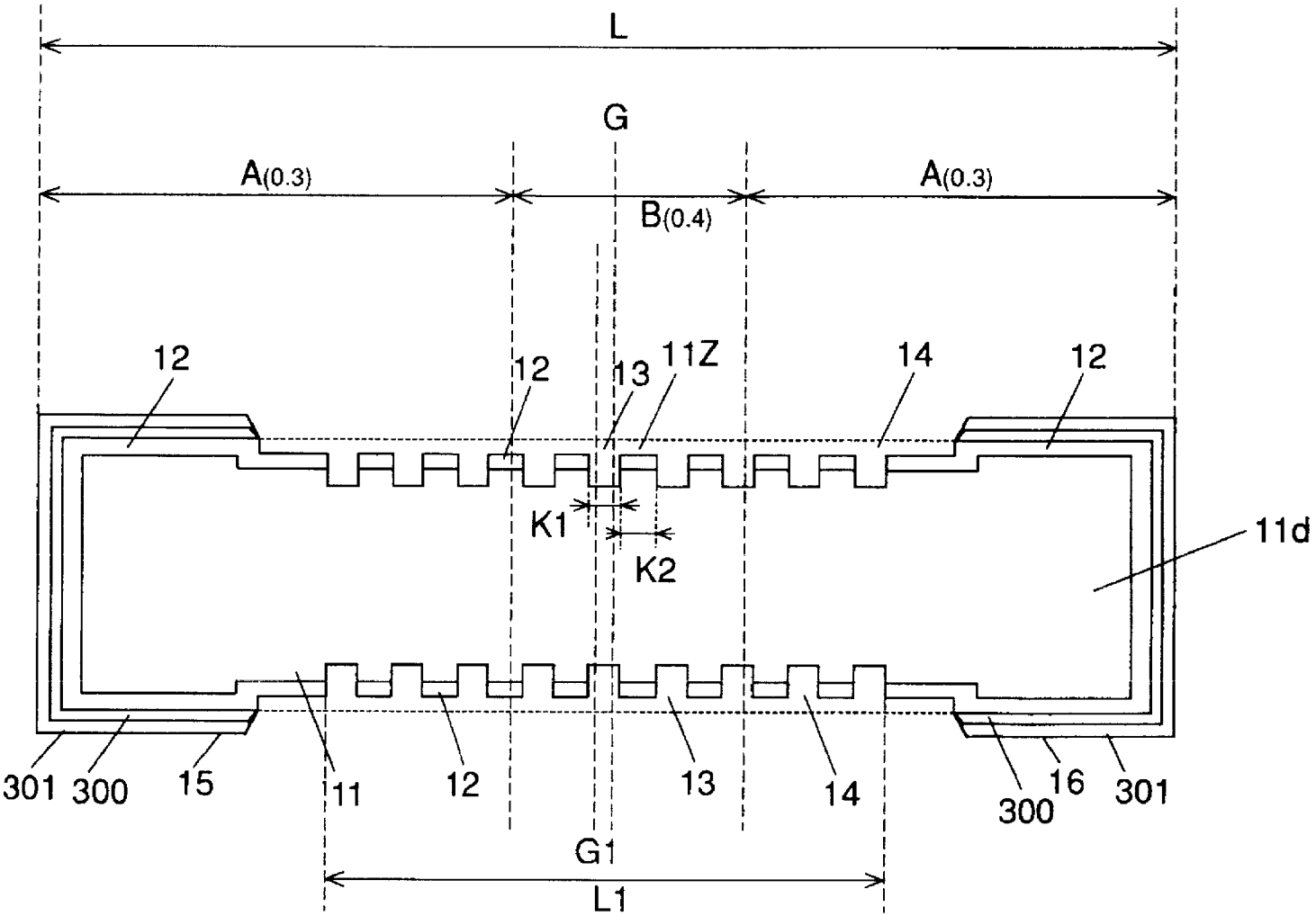
FIG. 2 is a side sectional view of the chip antenna in embodiment 1 of the invention.

FIG. 1 and FIG. 2 are a perspective view and a side sectional view of a chip antenna in a preferred embodiment of the present invention, respectively. In FIG. 1, conductive film 12 in a helical shape is disposed on a side face of core body 11 of the chip antenna. Groove 13 in a helical shape is made in core body 11 and conductive film 12. Protection member 14 is provided on conductive film 12. Terminal portions 15 and 16 of the chip antenna each have a terminal electrode on an end face thereof.

It is preferred that the chip antenna of the embodiment have operating frequency bands belonging to a microwave range of 0.7–7.0 GHz and have length L1, width L2, and depth L3 of the chip antenna as follows:

L1 =4.0–40.0 mm;

L2 =0.5–5.0 mm; and

L3 =0.5–5.0 mm.

When L1 is below 4.0 mm, the value of inductance becomes much smaller than required and it becomes impossible to obtain the antenna operation at a desired frequency range. When L1 is above 40.0 mm, the element itself becomes large and, when it is mounted on an electronic circuit board (hereinafter briefly referred to as "circuit board"), a difficulty in providing a smaller-sized circuit board and the like arises. Further, when L2 and L3 are each below 0.5 mm, the mechanical strength of the element itself becomes too weak and, hence, when it is mounted on a circuit board or the like by the use of a circuit component mounting apparatus, it can occur that the element is damaged by being broken, for example. When, on the other hand, L2 or L3 is above 5.0 mm, a difficulty arises in the provision of a smaller-sized circuit board, as was mentioned above with respect to L1, and hence it becomes difficult to provide smaller-sized apparatus.

Description of each part of a chip antenna structured as above will be given in the following.

1. Core Body (1) Material

Ingredients of core body 11 are preferred to meet the following characteristics:

Intrinsic volume resistance: $10^{13}\Omega\cdot m$ or above (more preferably $10^{14}\Omega\cdot m$ or above)

Thermal expansion coefficient: $5\times10^{-4}/°$ C. or below (more preferably $2\times10^{-5}/°$ C. or below), where the value of the thermal expansion coefficient is within a range of 20° C.–500° C.

Relative dielectric constant: 40 or below (more preferably 20 or below), where the value of the relative dielectric constant is at 1 MHz.

Bending strength: 1300 kg/cm$^2$ or above (more preferably 2000 kg/cm$^2$ or above)

Sintered density: 92% or above (more preferably 95% or above) of theoretical density When intrinsic volume resistance is below $10^{13}\Omega\cdot m$, a leakage current is generated between conductive films and thereby a loss in the antenna gain is caused. When thermal expansion coefficient is above $5\times10^{-4}/°$ C., a crack or the like can be produced in core body 11 when it is subjected to heat shock. More specifically, when thermal expansion coefficient is below the above mentioned value, occurrence of cracking or the like can be effectively prevented even if core body 11 is locally heated to a high temperature by irradiation of a laser beam or frictional heat of a grindstone used for forming groove 13. When relative dielectric constant is above 40, electrostatic capacitance between conductive films becomes not negligible and, as with the case where intrinsic volume resistance is lowered, a leakage current is generated between conductive films 12, whereby a loss in the antenna gain is caused. When bending strength is below 1300 kg/cm2, the element can be damaged by being broken when it is mounted on a circuit board or the like by the use of a mounting device. When sintered density is lower than 92% of the theoretical density, the percentage of water absorption of core body 11 becomes high. As a result, characteristics of core body 11 are greatly deteriorated, hence its characteristics as the antenna element become deteriorated, and its breaking strength is deteriorated to make it impossible to secure its sufficient mechanical strength.

As the material for obtaining the above mentioned characteristics, a ceramic material containing alumina as the main ingredient is normally used. However, the above mentioned characteristics cannot be obtained by using a ceramic material containing only alumina as the main ingredient. It is because such characteristics vary greatly with the pressure applied when fabricating the core body 11, burning temperature, and additives. Thus, suitable adjustments of fabricating conditions are required. As concrete fabricating conditions, it is preferred that the applied pressure when fabricating core body 11 be 2–5 t, the burning temperature be 1500–1600°, and the burning duration be 1–3 hours. As the alumina material, that containing 92% or above by weight of $A1_2O_3$, 6% or below by weight of $SiO_2$, 1.5% or below by weight of MgO, 0.1% or below by weight of $Fe_2O_3$, and 0.3% or below by weight of $Na_2O$, is preferred.

Also, ceramic materials of forsterite, magnesium titanate series, calcium titanate series, zirconia-tin-titanium series, barium titanate series, lead-calcium-titanium series, and the like may be used. As the ingredients of core body 11, ferromagnetic material such as ferrite or heat-resistant resin material may be used.

Thus, by specifying intrinsic volume resistance, thermal expansion coefficient, relative dielectric constant, bending strength, and sintered density of core body 11 as described above, the antenna gain is prevented from lowering and satisfactory electrical performance of the antenna as ia chip antenna element for surface mounting can be obtained and a high-performance antenna can be realized. Further, since thermal strength of the antenna when subjected to heat shock is secured, occurrence of cracking and the like in core body 11 can be prevented and production defective thereof can be reduced. Further, since sufficient mechanical strength of the antenna is secured, mounting on a circuit board or the like can be carried out by the use of a general-purpose mounting apparatus or the like and thus good effect of improved productivity and so on can be obtained.

(2) Shape

First, the shape of core body 11 will be described.

It is preferred that core body 11 be formed into a quadrangular cylinder shape or a circular cylinder shape. Especially, by forming core body 11 into a quadrangular cylinder shape as shown in FIG. 1 and FIG. 2, the structure is greatly simplified and mounting workability is improved. Further, since the core body is prevented from rolling about, productivity is improved and cost is reduced. Especially, by selecting a regular quadrangular cylinder shape out of quadrangular cylinder shapes, mounting and positioning of elements on the circuit board can be made much easier. Meanwhile, when core body 11 is formed into a circular cylinder shape, the depth and the other dimensions of groove 13 can be formed with precision when groove 13 is made in conductive film 12 formed on core body 11 by laser processing or grindstone processing as described later, and hence, an advantage can be obtained in that variation in characteristics is suppressed.

Further, in the vicinity of both end portions of core body 11, there are provided stepped portions 11z all around the circumference of core body 11. Groove 13 is provided in the portion between stepped portions 11z. It is preferred that stepped portions 11z be 30–500 μm deep. Stepped portions 11z are provided for separating the portion acting as the antenna from the circuit board or the like, so that the portion is prevented from contacting conductive film 12 which may damage the conductive film 12 or from coming close to the circuit pattern which may vary the antenna characteristics. The provision of stepped portions 11z is not necessarily needed if the risk of conductive film 12 coming into contact with the board is eliminated by devising such a means as to provide a hole or a recess in the circuit board.

While it is preferred that the cross-section of core body 11 at both end portions be made into a circular or polygonal shape as described above, it is especially preferred that it be made into a regular polygonal shape because little variation in characteristics is produced on whatever side face the mounting may be made. The same can be said of the cross-section of the stepped portion. Incidentally, it is not necessarily required that the cross-sectional shape of stepped portions 11z and the cross-sectional shape of both end portions be the same.

Chamfered portion of core body 11 will now be described. There are chamfers provided on the corner portions of core body 11. It is preferred that radius of curvature R of the chamfer satisfy the following relationship:

$$0.1<R1<0.5(\text{mm}).$$

When R1 is smaller than 0.1 mm, the corner portion of core body 11 has a sharply pointed shape. Therefore, when conductive film 12 is formed by sputtering or vapor deposition, there is a possibility of its breaking or peeling off at the ridge portion. Further, the corner portion can be chipped or damaged even by being subjected to a slight shock and this leads to deterioration in characteristics. If, on the other hand, R1 is greater than 0.5 mm, soldering may become insufficient at the time of mounting on the circuit board or, then, air bubbles may be produced within the solder, the soldered portion may become too thin in the lateral direction, or, in the extreme, soldering may become unachievable.

(3) Method for Processing

Core body 11 is processed by subjecting the above described material to press processing, extrusion processing, cutting processing, and the like. Here, attention should be paid to the surface roughness of core body 11. Every surface roughness mentioned below means average roughness along the longitudinal direction. The surface roughness of the conductive film, to be discussed later, also means average roughness along the longitudinal direction. It is preferred that the surface roughness of core body 11 be within a range of 0.1–1.0 μm. When the surface roughness is smaller than 0.1 μm, the bonding strength therewith of conductive film 12 is weakened and when it is greater than 1.0 μm, the conductor loss of conductive film 12 increases and the antenna gain suffers deterioration.

In the present embodiment, the bonding strength between conductive film 12 and core body 11 is increased by adjusting the surface roughness of core body 11. Further, by providing a buffer layer between core body 11 and conductive film 12 formed, for example, of at least one of simple substance carbon, carbon with other elements added thereto, simple substance Cr, and an alloy of Cr and another metal (Ni—Cr alloy), the bonding strength between conductive film. 12 and core body 11 can be increased without making adjustments to the surface roughness. Still stronger bonding strength can of course be obtained if a buffer layer and conductive film 12 are deposited on core body 11 after its surface roughness has been adjusted.

2. Conductive Film (1) Material

Conductive material such as copper, silver, gold, and nickel is used as the ingredient material of conductive film 12. A certain element may be added to such a material to enhance weather resistance thereof or an alloy of a conductive material and a non-metallic material may be used therefor. In the present embodiment, copper and its alloy are used for economy, corrosion resistance, and ease of processing. Further, by making conductive film 12 from at least one of materials selected from a material group of gold, platinum, palladium, silver, tungsten, titanium, nickel, tin, and copper or from at least one of alloy materials of an element selected from the above mentioned material group and an element not belonging to the material group, the film can be bonded onto the land, for example, of a circuit board with the use of solder or lead-free solder. Incidentally, a structure that has conductive film 12 formed into a helical shape is used as the antenna element in the present embodiment, however, a line-shaped member, such as a conductive wire, wound around the periphery of core body 11 may also be used. In this case, since loss in the conductive wire is smaller than in the conductive film, the antenna gain can be improved.

(2) Shape

Since core body 11 is circular cylinder shaped or regular polygonal cylinder shaped, conductive film 12 is formed to be symmetrical about the axis so that it is not necessary to specify its surface to be mounted on a circuit board. Since it is also symmetrically arranged about the center in the longitudinal direction, it is not necessary to specify its direction in the longitudinal direction when it is mounted on a circuit board. Film thickness of conductive film 12 is preferred to be within a range of 1–50 μm. When the thickness is smaller than 1 μm, the skin depth necessary for conducting high-frequency current cannot be adequately secured. When, on the other hand, it is greater than 50 μm, though a sufficient skin depth can be secured, its productivity is impaired and environmental resistance is deteriorated when subjected to heat shock. Width K1 of groove 13 formed in conductive film 12 and width K2 of conductive film 12 shown in FIG. 2 are determined by the operating frequency, gain of the antenna, and the outer shape of the antenna. They may preferably have following relationships:

$$20\mu\text{m}<K1<500\ \mu\text{m}$$

$$5\mu\text{m}<K2<500\ \mu\text{m}$$

The reason is that, when K1 is less than 20 μm, such a disadvantage arises that sufficient reliability of insulation between conductive films 12 cannot be secured. When, on the other hand, K1 is greater than 500 μm, such a disadvantage arises that the inductance value necessary for the antenna operating frequency cannot be adequately secured.

Further, when K2 is smaller than 5 μm, the antenna impedance of conductive film 12 forming the antenna becomes too high and this produces such a disadvantage that the impedance matching with the transmission line on the circuit board cannot be obtained and the antenna gain is deteriorated due to increase in conductor loss. When, on the other hand, K2 is greater than 500 μm, such a disadvantage arises that the inductance value necessary for the antenna operating frequency cannot be adequately secured.

(3) Method for Formation

As the methods for forming conductive film 12, plating (electrolytic plating, electroless plating, and the like), sputtering, vapor depositing, and the like can be applied. Out of the above methods, the plating method is used in the present embodiment because it is suitable for mass production and produces small variation in the film thickness. When copper or the like is used as in the present embodiment, an undercoat film is first formed on core body 11 by non-electrolytic plating. On the undercoat film, a specified copper film is formed by electrolytic plating. When conductive film 12 is formed from an alloy or the like, use of sputtering or vapor depositing is preferred.

Surface roughness of conductive film 12 may preferably be less than 5 μm, or more preferably be less than 2 μm. When the surface roughness of conductive film 12 is greater than 5 μm, such a disadvantage arises that the antenna gain is deteriorated due to increase in conductor loss.

Although a helical antenna element portion (the portion acting as the antenna) was provided in the present embodiment by making groove 13 in conductive film 12 formed by a thin film technology and the like, it may be provided, as mentioned above, by winding a conductive wire around core body 11 and electrically connecting both ends of the conductive wire to terminal portions 15 and 16 by thermocompression bonding, bonding agent, or the like.

3. Protection Member (1) Material

As protection member 14, an insulating organic material having a good weather resistance such as epoxy resin is used. It is preferred for protection member 14 to be transparent so that status conditions of conductive film 12 and groove 13 can be visually checked. It is further preferred that protection member 14 have a specific color with transparency. By providing protection member 14 with color such as red, blue, and green different from colors of conductive film 12, terminal portions 15 and 16, and the like, every part of the element can be identified and this facilitates inspection of each component of the element. Further, by changing the color of protection member 14 according to size, characteristic, product number, and the like of the element, mistakes in the process of mounting on the circuit board can be reduced.

(2) Shape

It is preferable that the resin protection member formed on the conductive film have thin and uniform film thickness all over the periphery of the helical conductor.

(3) Method for Formation

Protection member 14 may be provided by forming a coat of resin or the like and then drying. Protection member 14 may also be provided by electrolytic deposition (for example, cationic electrolytic deposition). In this case, a thin and uniform film can be formed and the deposited material is prevented from entering groove 13 in quantity. Therefore, variation in antenna operating frequency can be suppressed and hence this method is considered most favorable. In addition, this method is suitable for mass production. Incidentally, protection member 14 is required when weather resistance and the like are desired. If they are not desired, protection member 14 may not be provided.

4. Terminal Portion (1) Material

Terminal portions 15 and 16 are arranged in multiple-layered structure as shown in FIG. 2. Protection layer 300 placed over conductive film 12 is formed by using material such as nickel and titanium. In the present embodiment, at least one of nickel and nickel alloy is used. Bonding layer 301 placed over protection layer 300 is formed by using solder or lead-free solder. The thickness of protection layer 300 (nickel) is preferred to be within a range of 1–8 μm. It is because weather resistance is impaired if the thickness is smaller than 1 μm and, if the thickness is greater than 8 μm, the electric resistance of protection layer 300 (nickel) itself becomes high and, thereby, antenna characteristics are greatly deteriorated. Further, it is preferred that the thickness of bonding layer 301 (solder) is within a range of around 5 μm–20 μm. If it is smaller than 5 μm, a good joint with the circuit board or the like cannot be obtained due to shortage of the quantity of solder and, when it is greater than 20 μm, productivity is impaired because a large quantity of solder is used. When weather resistance is not necessary, protection layer 300 may be omitted.

(2) Shape of End Face

Figure 3A:
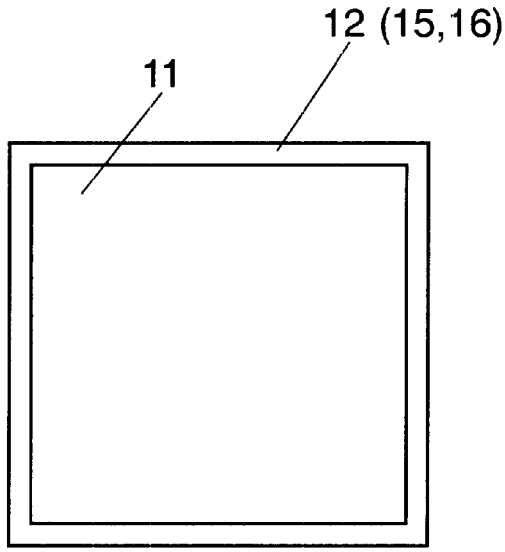
FIGS. 3(*a*) and (*b*) are side views of a terminal portion showing the chip antenna in embodiment 1 of the invention.
Figure 3B:
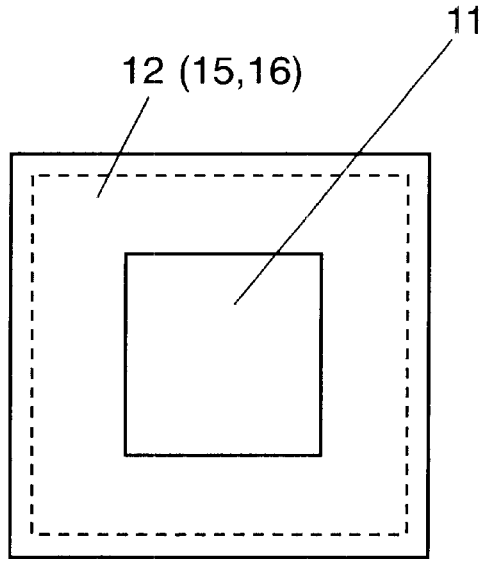

Terminal portions 15 and 16 are provided at both end portions of core body 11 and the shape thereof depends on the shape of core body 11. The shape of the end face of the terminal portion of the present embodiment is shown in FIG. 3(*a*) and FIG. 3(*b*). While conductive film 12 is provided on the whole portion of the end face of core body 11 in the present embodiment, it can be arranged such that the end face of core body 11 is exposed, i.e., such that no conductive film 12 is present on the whole portion of the end face of core body 11 as shown in FIG. 3(*a*). It may otherwise be arranged such that a portion of the end face of core body 11 is exposed by providing such a portion where no conductive film is present as shown in FIG. 3(*b*). This arrangement is made for eliminating formation of a shielding conductor surface to distort the high-frequency magnetic field of the helical antenna element, thereby reducing the antenna loss and enhancing the antenna gain. The shape of the no-conductor provided portion (the portion where core body 11 is exposed) may be square as shown in the drawing or it may be other shape such as circular, oval, triangular, and polygonal shape. The area is required to be at least 30% of the end face of core body 11. If the area is smaller than that, it is known that its effect is not fully exhibited.

(3) Method for Formation

Though conductive film 12 alone can sufficiently function as terminal portions 15 and 16, it is formed in a multiple-layered structure in the present embodiment for improving environmental resistive performance. Conductive film 12 is formed in the layer over end portion 11*d* of core body 11. Protection layer 300 is formed in the layer over conductive film 12 and, further, bonding layer 301 is formed in the layer over protection layer 300 by plating. Protection layer 300 serves not only for enhancing weather resistance but also for increasing the bonding strength between conductive film 12 and bonding layer 301. Bonding layer 301 is provided for ease of electrical connection with the conductive pattern on the circuit board.

When at least one of protection layer 300 and bonding layer 301 is provided as terminal portion 15, 16 as shown in FIG. 2, the end face of core body 11 may be exposed as described above. Further, such an arrangement may be made in which the conductive film is not formed on each end face of core body 11 but at least one of protection layer 300 and bonding layer 301 is disposed thereon. Though the effect of eliminating the shielding conductor surface is somewhat reduced in this arrangement as compared with the case that a conductive film is provided on the whole portion of each end faces of core body 11, characteristics can be improved over the case where conductive film 12 is formed all over the end face of core body 11.

Further, in order to have any side faces of terminal portions 15 and 16 can be the surface to be mounted at the time of chip antenna mounting, it is preferred that conductive film 12 be provided all over the side face of terminal portions 15 and 16 or it is preferred that at least one of bonding layer 301 and protection layer 300 be disposed on conductive film 12 provided as described above.

5. Relationship between Arrangement and Characteristics

At the conclusion of the present embodiment, the relationship between the arrangement of the antenna element portion formed of a helical conductive film and the characteristics will be explained. Concerning the chip antenna of the present embodiment, investigation has been made as to the arrangement of the antenna element portion formed of helical conductive film 12 with respect to the longitudinal direction of core body 11 to obtain a condition in which variation in the operating frequency is kept small whichever of terminal portion 15 and terminal portion 16 may be used as the feeding portion. As a result, it has been found that satisfying the following relationship is significant.

Namely, with reference to FIG. 2, it is desirable that the center in the longitudinal direction of the antenna element portion defined by the groove formed on the core body be located in region B shown in FIG. 2.

More specifically, when the total length of the chip antenna is denoted by L and the regions extending from both ends to the point 0.3×L (preferably 0.4×L or more preferably 0.45×L) are defined by A, and further when the center in the longitudinal direction of the chip antenna is denoted by G and the regions extending toward both ends from center G by the length of 0.2×L (preferably 0.1×L or more preferably 0.05×L) are defined by B, then, the arrangement is made such that center G1 of length L1 of the antenna element portion is located in region B, where length L1 of the antenna element portion is the distance between grooves at both ends thereof. By virtue of this arrangement, variation in the operating frequency can be kept small whichever of terminal portion 15 and terminal portion 16 may he used as the feeding portion.

Figure 4:
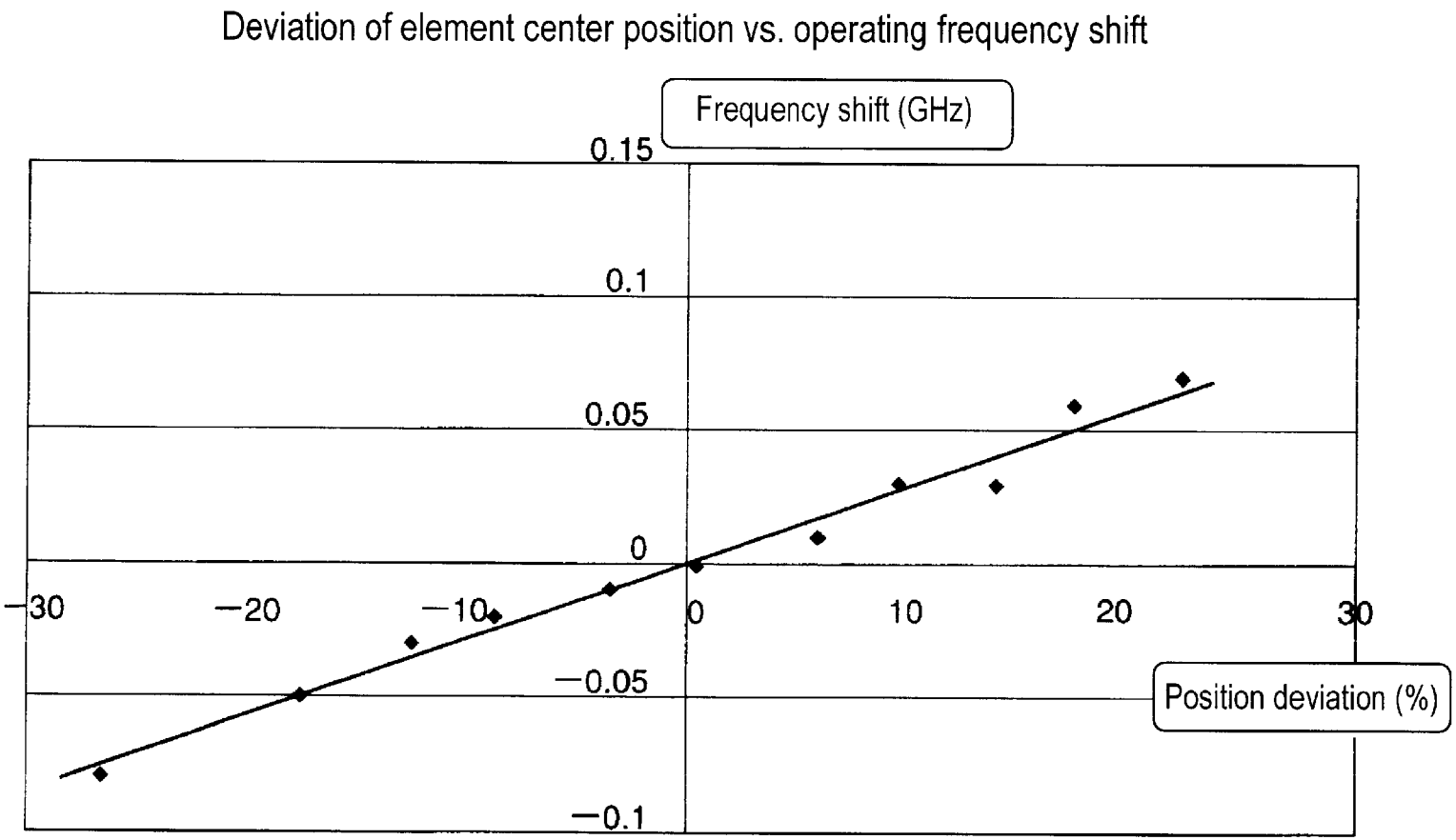
FIG. 4 is a graph explanatory of the position where the center of the antenna element is located and the operating frequency.

The above described center of the antenna element portion and variation in the operating frequency will be described with reference to FIG. 4. FIG. 4 is a graph explaining the position of the center of the chip antenna element relative to the operating frequency. The axis of abscissas represents the relative distance between the position of the center of a chip antenna and the position of the center of the antenna element portion (by percentage on the total length of the, chip antenna) and the axis of ordinates represents variation at each position from the originally designed operating frequency 2.41 GHz of the antenna. Here, an operating frequency means the frequency at which the antenna gain is at the maximum. While the normally desired variation in the operating frequency of a chip antenna is within 2%, it is known from the graph that the relative length between the center of the chip antenna and the center of the antenna element portion must be set within ±20% of the total length of the antenna in order to keep the variation in the operating frequency of the chip antenna within 2%.

This indicates that impedance of the chip antenna increases and the operating frequency decreases according as the antenna element portion with high impedance, i.e., the helical conductive film, approaches the feeding portion of the antenna (terminal portion 15 or 16) where the current flow is maximum Conversely, this indicates that impedance of the chip antenna decreases and the operating frequency increases according as the high-impedance antenna element portion, i.e., the helical conductive film, goes away from the feeding portion of the antenna.

Thus, in order to configure a chip antenna producing little variation in the operating frequency whether terminal portion 15 or terminal portion 16 is used as the feeding portion, it is known that center G1 of the antenna element portion must be placed within a range of 0.2×L toward both ends from center G in the longitudinal direction of the chip antenna.

As described above, by having the center of the antenna element portion located in region B, only little change in the operating frequency is produced no matter which of the terminal portions may be used as the feeding portion. Thus, since the terminal portion predetermined as the feeding portion needs not to be used as the feeding portion at the time of mounting and, hence, mountability is greatly enhanced.

Further, as the means for reducing variation in the operating frequency whether terminal portion 15 or terminal portion 16 is used as the feeding portion, such a configuration may be made to dispose both ends of groove 13 (starting point and ending point of the helix) on the same side of flat side face 11*a* as shown in FIG. 1 or to dispose them on the same ridge line (not shown). Thus, it is made possible to allow the number of turns of helical conductive film 12 of the antenna element portion to become an integer or a number close to an integer. Therefore, variation in the operating frequency can further be suppressed. If, for example, the structure is such that has one end of groove 13 on one side face 11*a* and the other end of the groove 13 on the side face opposite to side face 11*a*, a problem arises that the operating frequency at the time when terminal portion 15 is used as the feeding portion differs from that at the time when terminal portion 16 is used as the feeding portion.

Figure 5:
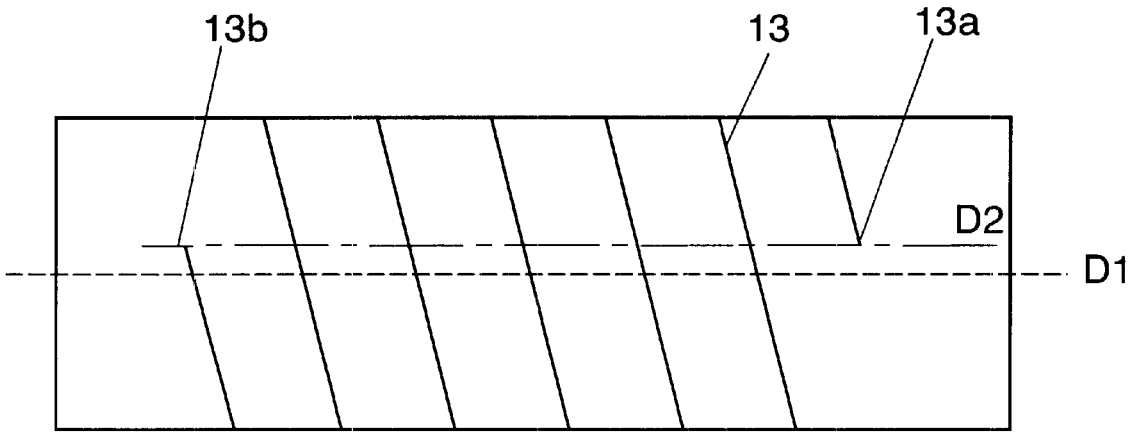
FIG. 5 is a portion of a side view of a chip antenna in another form of embodiment 1 of the invention.

When core body 11 is circular cylinder shaped, straight line D2 connecting end portions 13*a* and 13*b* of groove 13 is arranged in parallel with center line D1 in the longitudinal direction of core body 11 or they are arranged so as to intersect each other at an angle less than ±5° as shown in FIG. 5. Thus, the number of turns of the antenna element portion is allowed to become an integer or a number close to an integer.

Since the helical conductive film configured as described above has a function as an antenna element portion, very high productivity can be obtained. Further, since width of conductive film 12, groove 13, and the like can be set suitably, characteristics can be adjusted with ease. Further, by forming the cross-section of terminal portions 15 and 16 into a regular polygonal shape or a circular shape, symmetry about the axis can be obtained, and therefore, no matter which side face of terminal portions 15 and 16 may be used as the feeding portion, no change is produced in the characteristics. Furthermore, because of symmetry with respect to the center in the longitudinal direction, no matter which of terminal portions 15 and 16 may be used as the feeding portion, no change is produced in characteristics so that mountability is greatly enhanced. Further, since conductive film 12 is fixedly attached to core body 11, such a non-uniformity that the pitch between conductors varies, as with conductors wound around a core body, does not occur and stable characteristics can be secured for a long time. Although the case where the width and pitch of helical conductive film 12 are uniform has been shown in the drawings, they need not necessarily be uniform. The width and pitch of conductive film 12 may be varied with conductive film arranged virtually symmetrical about the center in the longitudinal direction of the antenna element portion.

If directionality is allowed to be produced, the width and pitch of conductive film 12 may be varied along the axial direction of the antenna element portion. At this time, if the pitch on the side toward the terminal not connected with the circuit is made smaller, miniaturization of chip antenna can be attained while the antenna gain is kept from decreasing.

<Embodiment 2>

Figure 6:
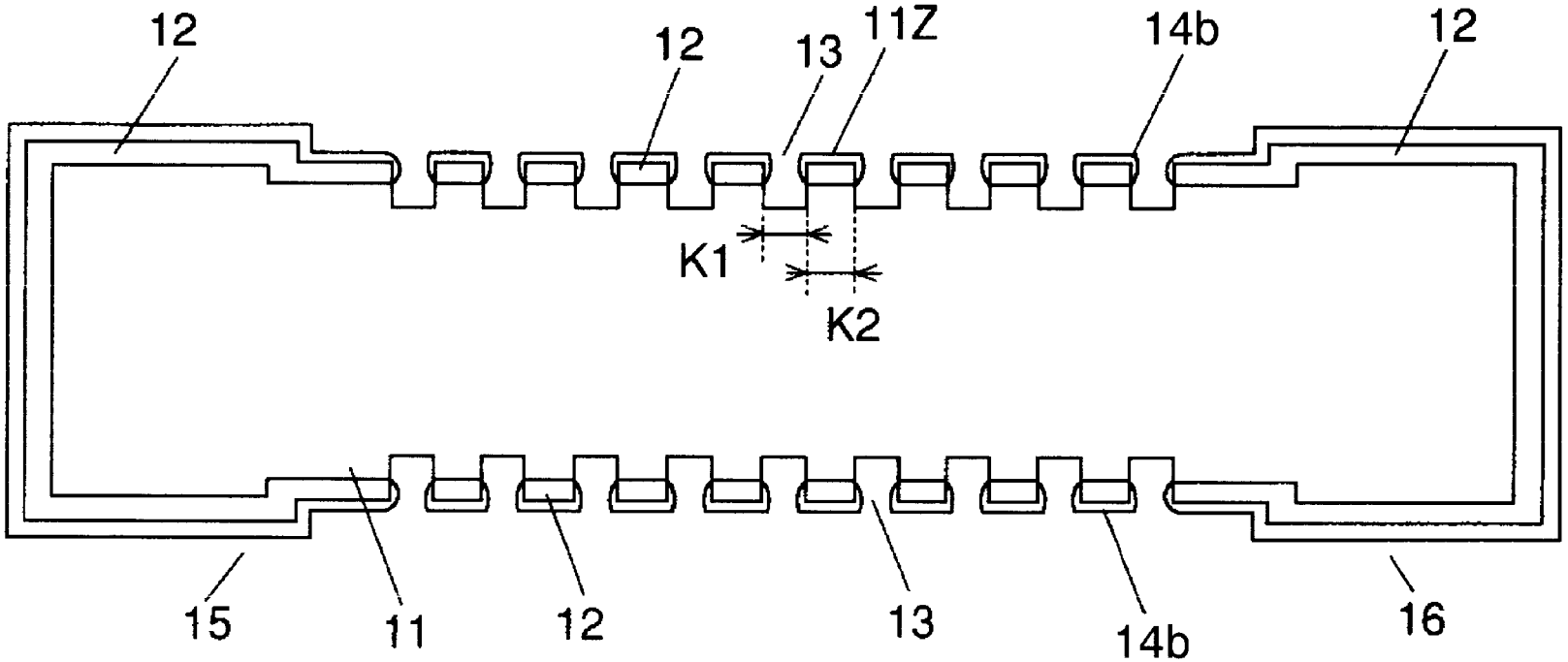
FIG. 6 is a side sectional view showing a chip antenna in embodiment 2 of the invention.

FIG. 6 is a side sectional view of a chip antenna showing embodiment 2 of the invention. The point of this embodiment that is different from embodiment 1 is in the protection member of the conductive film. In this embodiment, differing from polymeric material such as resin used in embodiment 1, a metallic film or the like is used as the protection member 14*b* as shown in FIG. 6. In this case, protection member 14*b* shown in FIG. 6 is formed of metallic material having good weather resistance. The material is constituted of at least one material selected from a material group of gold, platinum, palladium, silver, tungsten, titanium, nickel, and tin, or an alloy material of a material selected from the above material group and element not belonging to the material group. Especially from the point of view of cost and weather resistance, gold or gold alloy, or tin and tin alloy (excluding tin-lead alloy) is preferred. Protection member 14*b* may preferably be formed by plating, sputtering, vapor depositing, or the like.

Protection member 14*b* may be a single-layered structure or a multiple-layered structure of materials selected from the above mentioned material group or alloy materials.

As to the style of formation of protection member 14*b*, the overall periphery of conductive film 12 may be covered with protection member 14*b* virtually completely so that protection of conductive film 12 can be ensured. First, conductive film 12 is formed on a part or the whole of core body 11, then groove 13 is formed, for example, in a helical shape (such that the center axis of remaining helical conductive film 12 lies along the longitudinal direction of core body 11), and then protection member 14 is formed by plating or the like. Thus, conductive film 12 is covered with protection member 14*b* virtually completely.

In this case, the film thickness of the protection member 141) is preferred to be within a range of around 0.05 $\mu$m–7 $\mu$m (preferably 0.1 $\mu$m–5 $\mu$m). If the thickness is smaller than 0.05 $\mu$m, a problem arises that sufficient weather resistance cannot be obtained, and if it is greater than 7 $\mu$m, a possibility of short-circuiting between adjacent conductive films arises, weather resistance is not improved so much, and it proves to be uneconomical.

As the material for protection member 14*b*, material having low electric resistance and not deteriorating antenna characteristics such as gold, gold alloy, platinum, platinum alloy, palladium, palladium alloy, tin, and tin alloy (excluding tin-lead alloy) may preferably be used.

When tungsten, titanium, nickel, or the like is used as protection member 14, such an advantage is also obtained that an oxide is formed on the surface and stable weather resistance can thereby be provided. In this case, antenna characteristics can vary to a certain degree through a long time of use but this antenna can be suitably put to use depending on antenna specifications. However, the problem can be solved by previously forming an oxide on the surface of protection member 14*b* at the time of fabrication and adjusting the antenna characteristics in this state to be kept constant. Thereafter, deterioration in characteristics can be prevented from occurring.

When a protection member is formed of a resin or the like, as in embodiment 1, unavoidable variation occurs in the applied amount of the resin to deteriorate the characteristics. Further, since the protection member is formed of resin, it sometimes occurs that the insulator is placed thickly on conductive film 12 functioning as the antenna and hence antenna characteristics are deteriorated. By forming it of metallic material having good weather resistance and preferably having low electric resistance, as in the present embodiment, the amount of protection member 14*b* used for each antenna element can be kept relatively constant, so that variation in the characteristics and deterioration in the antenna characteristics can be prevented.

Further, by using at least one material out of tin, tin alloy (excluding tin-lead alloy), gold, and gold alloy as protection member 14*b*, the antenna can be mounted directly on the circuit board and, further, lead-free components can be produced. Thus, such an advantage can be obtained that ecologically friendly chip antennas for surface mounting are provided.

<Embodiment 3>

Figure 7:
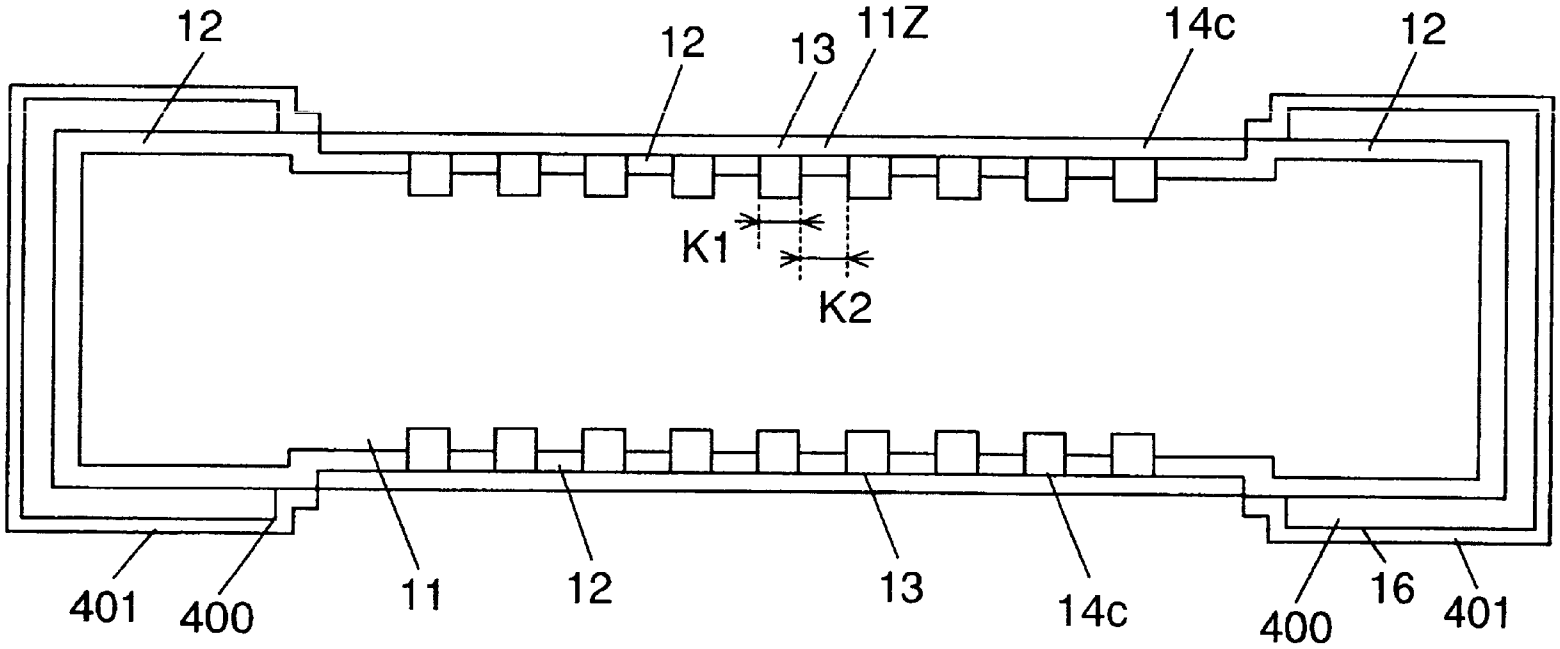
FIG. 7 is a side sectional view showing a chip antenna in embodiment 3 of the invention.

FIG. 7 is a side sectional view of a chip antenna showing embodiment 3 of the invention. The point of this embodiment that is different from embodiment 1 is in the protection member of the conductive film on the chip antenna.

When a coated resin material is used as the protection member, as shown in FIG. 2, or protection member 14 formed by electrolytic deposition is used, a great variation in the antenna characteristics may sometimes occur. More specifically, when a resin material having a certain value of dielectric constant is present in groove 13, it causes a variation in the antenna characteristics. The variation in the antenna characteristics will be suppressed if the quantity of the resin material entering groove 13 can be controlled but it is a difficult task in mass production. Thus, when epoxy resin or the like is applied to the antenna element portion, the quantity of resin entering groove 13 differs from chip antenna to chip antenna. The antenna characteristics vary according to how much the substance exists in groove 13. More specifically, the antenna characteristics greatly vary between a chip antenna in which epoxy resin is filled in groove 13 completely and a chip antenna in which epoxy resin is filled in groove 13 incompletely because of air bubbles or the like present in groove 13. The same can be said of the method of forming protection member 14 by electrolytic deposition, that is, the protection material enters groove 13 and the entering amount of the material is difficult to control. Incidentally, it is preferred that protection member 14 have heat resistance against the temperatures of 230° C. or above.

Then, the problem can be solved by forming protection member 14*c* in a tubular shape as shown in FIG. 7. In other words, when protection member 14*c* is formed in a tubular shape, the protection member 14*c* is completely prevented from entering groove 13 or, if the protection member 14*c* does enter groove 13, the entering amount is very small, and hence no substantial deterioration of the antenna characteristics is produced. More specifically, if the tubular member attempts to enter groove 13, the tubular member abuts on the surface of helical conductive film 12, whereby the tubular member is prevented from moving forward to reach the bottom of groove 13.

The tubular protection member 14*c* may be formed of an insulating material or, preferably, formed of a resin material with elasticity or plasticity. For example, a resin tube may be used as the tubular member. The tube is fitted on core body 11 so as to cover over the antenna element portion to be used as protection member 14*c*.

More preferably, the tubular member may be formed of a resin material having a heat-shrinking property (for example, polyvinylidene fluoride resin), namely, the tubular member is fitted on core body 11 and then the tubular member is subjected to a heat treatment at a predetermined temperature and, thereby, the tubular member shrinks and becomes fitted positively and tightly on the antenna element portion. Accordingly, the tubular member can be arranged so as to not readily fall off core body 11 and, further, dust and the like are prevented from getting into the antenna element portion so that occurrence of deterioration in characteristics can be prevented. At this time, it is preferred that the thickness of the tubular member after being heat-treated be set within a range of 0.1 mm–2.0 mm from the view points of insulation and weather resistance.

Further, as to the cross-sectional shape of core body 11 and the tubular member fitted thereon for serving as protection member 14*c*, it is preferred that the cross-sectional shape of the tubular member be determined in conformity with the cross-sectional shape of core body 11. For instance, if the cross-sectional shape of core body 11 is square, it is preferred that the cross-sectional shape of the tubular member also be made square.

When the tubular member has a circular cross-section, a good fit can be secured even if the cross-sectional shape of core body 11 is square if the tubular member is made of a heat-shrinkable resin as described above, from which merit can also be obtained since such components can be commonly used in mass production. If tubular members are used as protection members, merit can also be obtained such that, when a tubular member is found faulty, the tubular member can be cut off with a cutter or the like, and thus a reduction of defective products can be achieved.

Although no special tackiness agent or adhesive agent is used between the tubular member and conductive film 12 in the above described embodiment, when there is a problem with the bonding strength between tubular member and conductive film 12, a thermosetting resin or the like, for example, may previously be applied to the inner wall of the tubular member and then the products may be subjected to a heat treatment or the like so that the bonding strength between the tubular member and conductive film 12 is enhanced.

<Embodiment 4>

Figure 8:
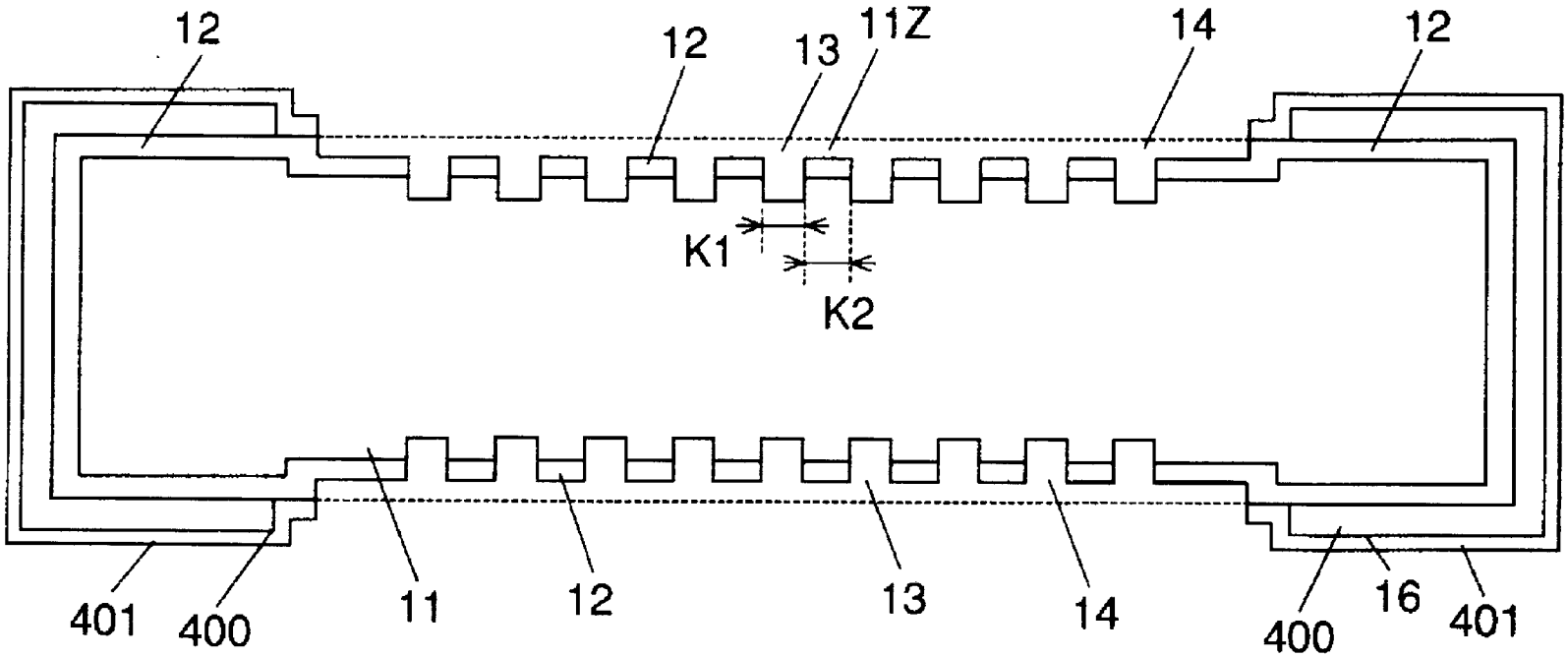
FIG. 8 is a side sectional view showing a chip antenna in embodiment 4 of the invention.

FIG. 8 is a cross-sectional side view of a chip antenna showing embodiment 4 of the invention. The point of this embodiment that is different from embodiment 1 is in the terminal portion of the chip antenna.

As terminal portions 15 and 16, bottomed metallic caps 400 having a U-shaped cross-section may be fitted on both ends of core body 11 as shown in FIG. 8. By having metallic caps 400 fitted on the ends, electrical connection thereof with conductive film 12 can be realized. Metallic cap 400 may be mounted by tight fitting or mounted by injecting a conductive bonding agent into a small gap previously formed between the metallic caps 400 and conductive film 12. By this configuration, the antenna element portion can be held separated from the board owing to the thickness of metallic cap 400 on the side face of core body 11 and hence change in characteristics can be reduced. Further, in order that electrical connection between metallic cap 400 and conductive film 12 is realized along a relatively large area, bonding layer 401 may be formed continuously extended over metallic cap 400 and conductive film 12 as shown in FIG. 8. Bonding layer 401 can be directly mounted on the circuit board by applying thereto a material such as tin, tin alloy (excluding tin-lead alloy), gold, and gold alloy by plating and, thus, an advantage can be obtained that a lead-free chip antenna is realized.

<Embodiment 5>

Figure 9:
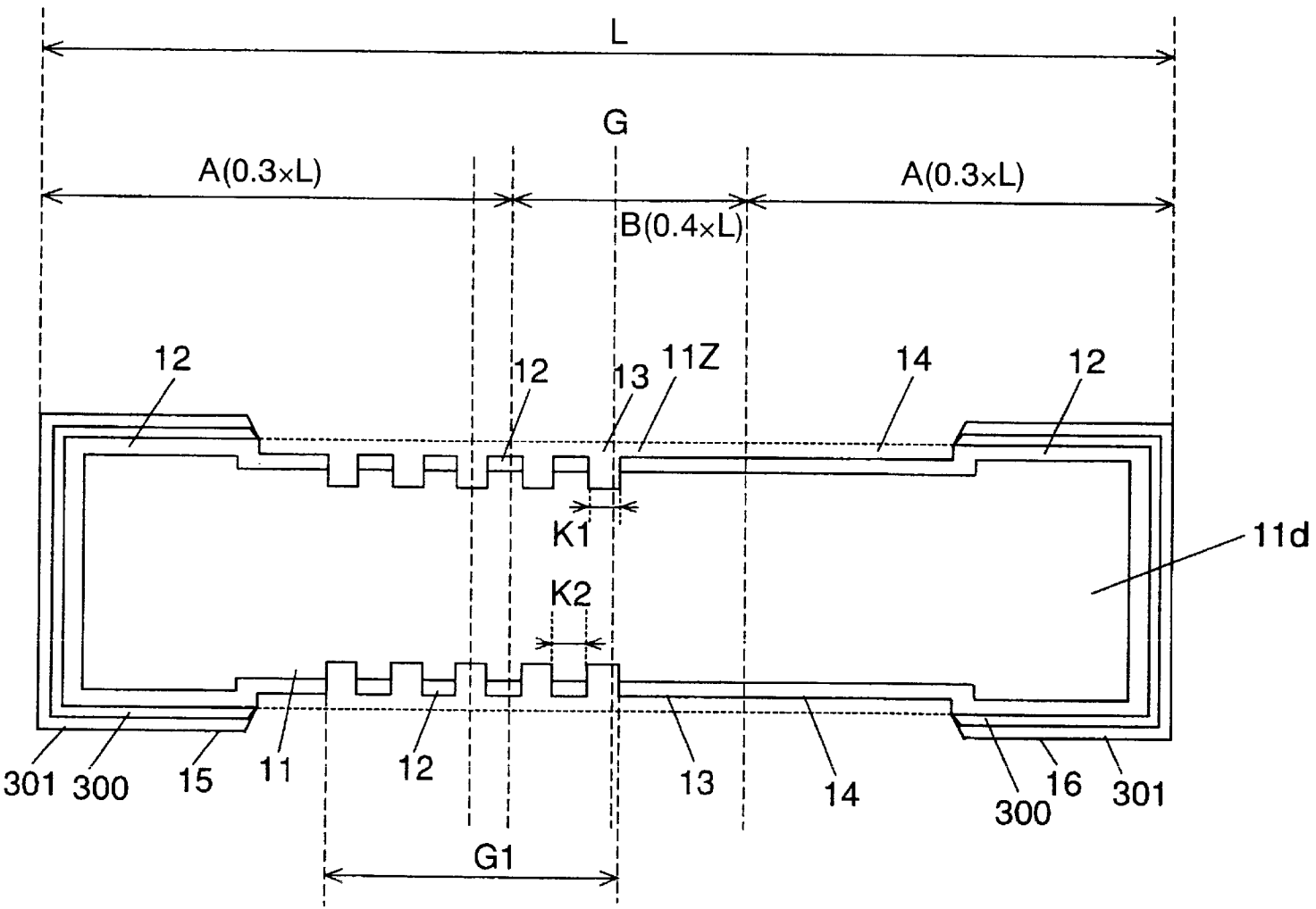
FIG. 9 is a side sectional view showing a chip antenna in embodiment 5 of the invention.
Figure 10:
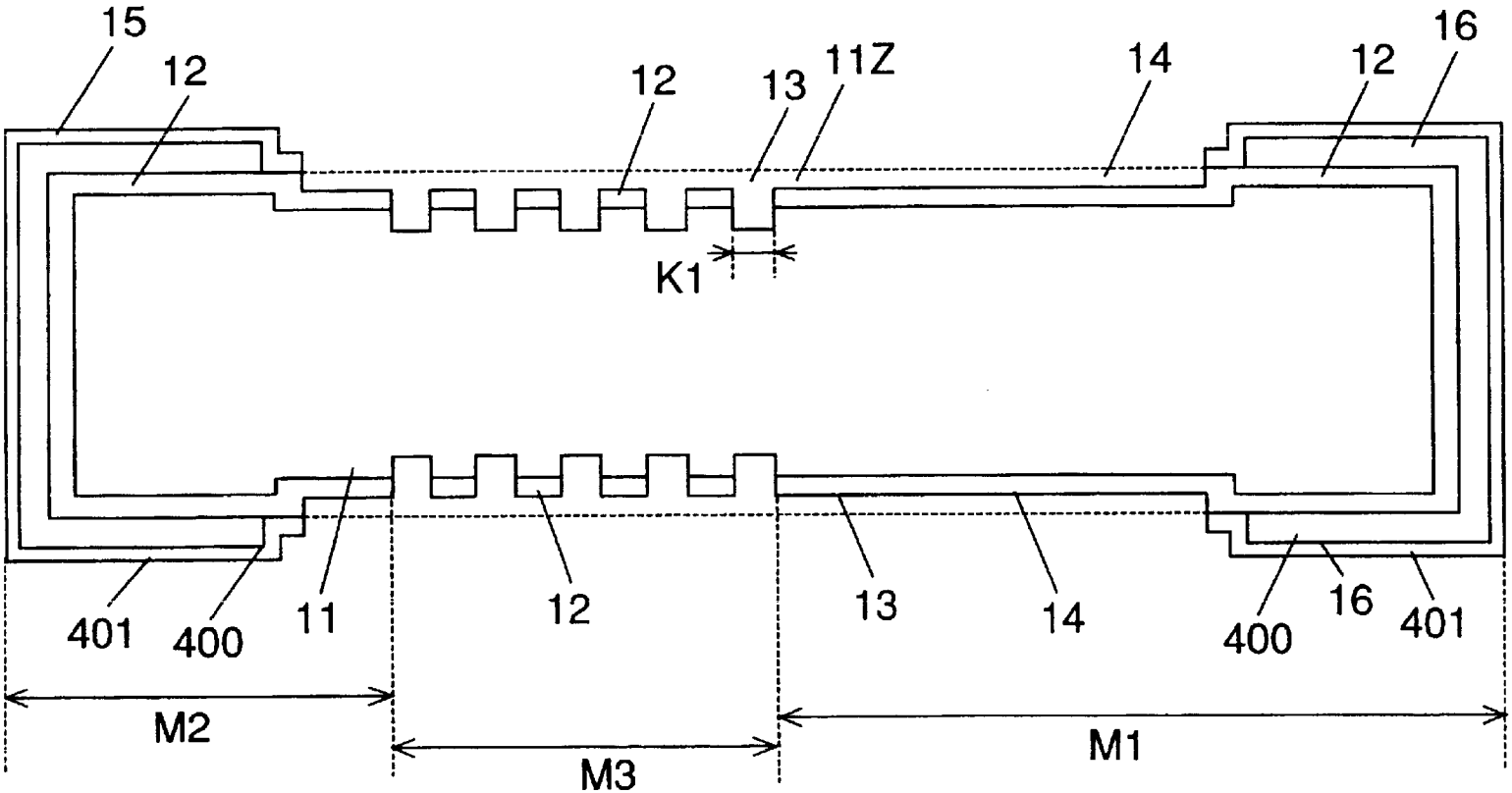
FIG. 10 is a side sectional view showing a chip antenna in another form of embodiment 5 of the invention.

FIG. 9 and FIG. 10 are cross-sectional side views of a chip antenna showing embodiment 5 of the present invention. The point of this embodiment that is different from embodiment 1 is in the manner of arrangement of the antenna element portion.

The antenna element portion is formed such that center G1 of the antenna element portion in the longitudinal direction of the antenna element is located within region A extending from both ends of the element to the points given by L×0.3, where L denotes the total length of the chip antenna. In other words, center G1 of the antenna element portion is not located in the vicinity of center G of the chip antenna (region extending from center G to the points at distances of ±L×0.2).

By virtue of such an arrangement, the operating frequency of the chip antenna is allowed to vary within a predetermined range according to whether terminal portion 15 is used as the feeding portion or terminal portion 16 is used as the feeding portion. Generally speaking, when such a chip antenna is mounted on a mobile telephone for example, the operating frequency of the chip antenna varies to a certain degree by being affected by metallic articles in the neighborhood. Accordingly, the operating frequency can be made different in the present embodiment according to whether terminal portion 15 is used as the feeding portion or terminal portion 16 is used as the feeding portion. Therefore, when such a chip antenna mounted on a unit is affected by metallic articles in the neighborhood and the operating frequency is shifted downward for example, the situation can be properly coped with, without using another chip antenna, by arranging the antenna such that the terminal portion having somewhat greater operating frequency is selected as the feeding portion.

In order to realize a chip antenna whose desired operating frequency on the circuit is 1.0 GHz, suppose now that a chip antenna whose operating frequency is 1.0 GHz is mounted on an actual circuit board with terminal portion 15 used as the feeding portion. Then, assume that the effective operating frequency is changed to 0.95 GHz by the effect of metallic articles in the neighborhood of the mounted position. In such case, if a chip antenna whose operating frequency will be 1.05 GHz when terminal portion 15 is used as the feeding portion and the operating frequency will be 0.95 GHz when terminal portion 16 is used as the feeding portion is prepared in advance and the chip antenna is mounted such that terminal portion 15 may become the feeding portion, it can be operated as a chip antenna having the desired effective frequency 1.0 GHz.

Though it is not shown in the drawing of the present embodiment, a marking or inscription may be made only on the side of the terminal portion where the operating frequency is larger to allow this side to be acknowledged visually or through electronic image processing, whereby, handling becomes easier and mounting of parts and assembly of the apparatus can be facilitated. The marking as described above may otherwise be made only on the side of the terminal portion where the operating frequency is smaller or markings may be made on both of the terminal portions with indications as to which side has higher operating frequency and how much the difference is. Printing on protection member 14 or making an inscription in protection member 14 itself may be made to indicate which terminal portion provides higher or lower operating frequency when used as the feeding portion and so on.

Referring to FIG. 10, when the total element length was set at 10 mm, distance M1 from one end of the antenna element portion to one end face of the core body was set at 4.8 mm, length M2 of the antenna element portion was set at 3.2 mm, and distance M3 from the other end of the antenna element portion to the other end face of the core body was set at 2 mm, the operating frequency when terminal portion 16 was used as the feeding portion was 1.582 GHz, while the operating frequency was 1.420 GHz when terminal portion 15 was used as the feeding portion. Further, when M1 was set at 4.8 mm, M2 was set at 3.65 mm, and M3 was set at 1.55 mm, the operating frequency when terminal portion 16 was used as the feeding portion was 1.608 GHz, while the operating frequency was 1.420 GHz when terminal portion 15 was used as the feeding portion.

Therefore, by arranging the antenna such that center G1 of the antenna element portion is located in region A indicated in FIG. 2 as described above, a sufficiently large difference can be obtained between the cases where terminal portions 15 and 16 are each used as the feeding portion and, thus, merit can be obtained in that a chip antenna having excellent usability is provided.

<Embodiment 6>

Figure 11:
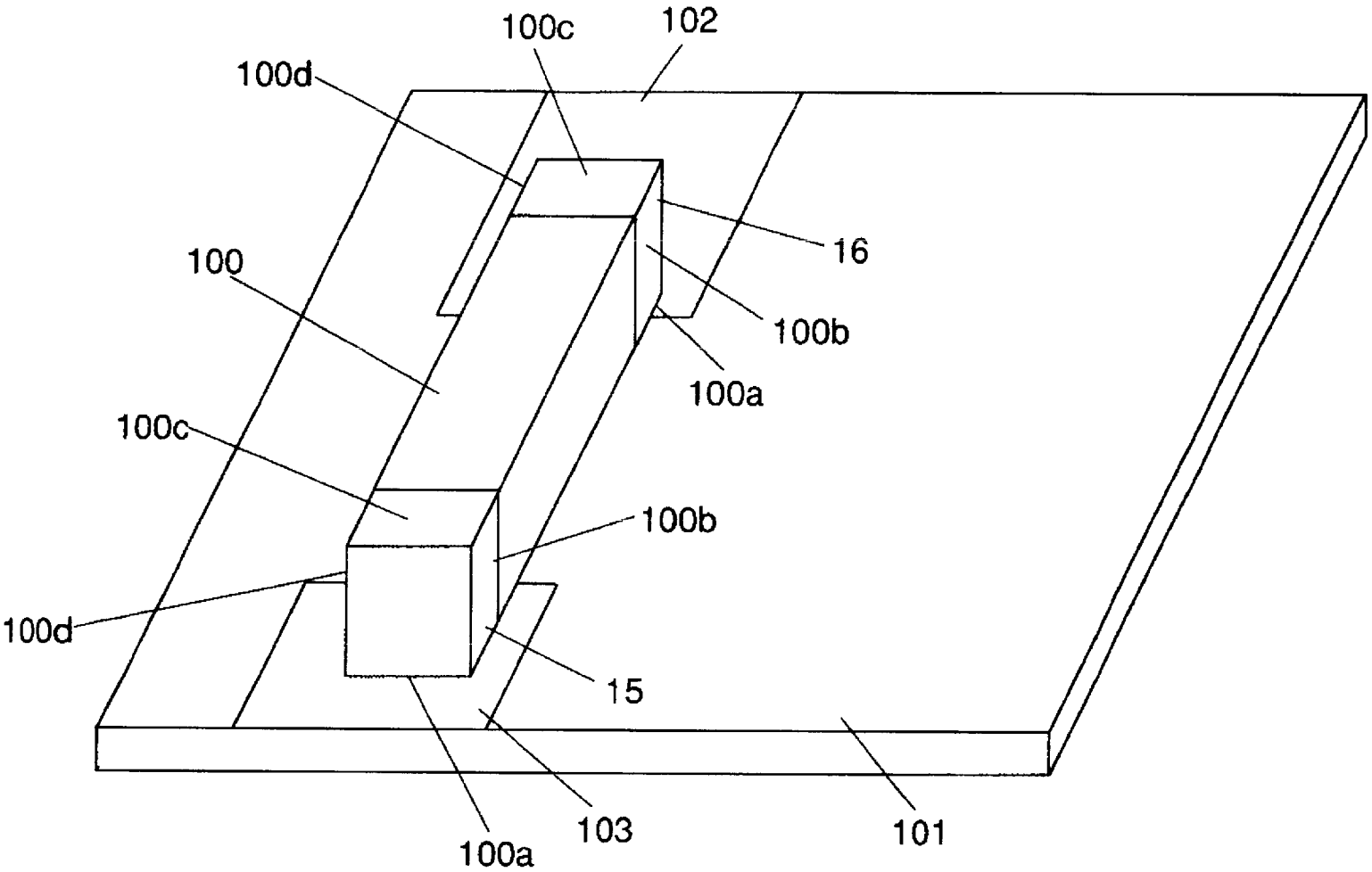
FIG. 11 is a perspective view showing a manner of mounting of a chip antenna of the invention on a circuit board.

FIG. 11 is a perspective view showing a state of mounting of a chip antenna on a circuit board representing embodiment 6 of the invention. Referring to FIG. 11, chip antenna 100 is the chip antenna shown in FIG. 1 and FIG. 2. On circuit board 101, there are provided at least fixing pattern 102 and feeding pattern 103 for connecting chip antenna 100 with a receive or transmit circuit. Though not shown, electronic components such as resistors, capacitors, inductance elements, and semiconductor elements are mounted on circuit board 101.

In the present embodiment, terminal portion 16 is connected with pattern 102 and terminal portion 15 is connected with pattern 103, but the connections may be reversed. Further, since the cross-section of terminal portions 15 and 16 are virtually square-shaped in the present embodiment, side face 100*a* is used as the surface for mounting. However, the change in the characteristics is very small even if side faces 100*b*, 100*c*, or 100*d* are used as the surface for mounting and, thus, the degree of freedom in the mounting of chip antenna 100 can be increased.

Figure 12:
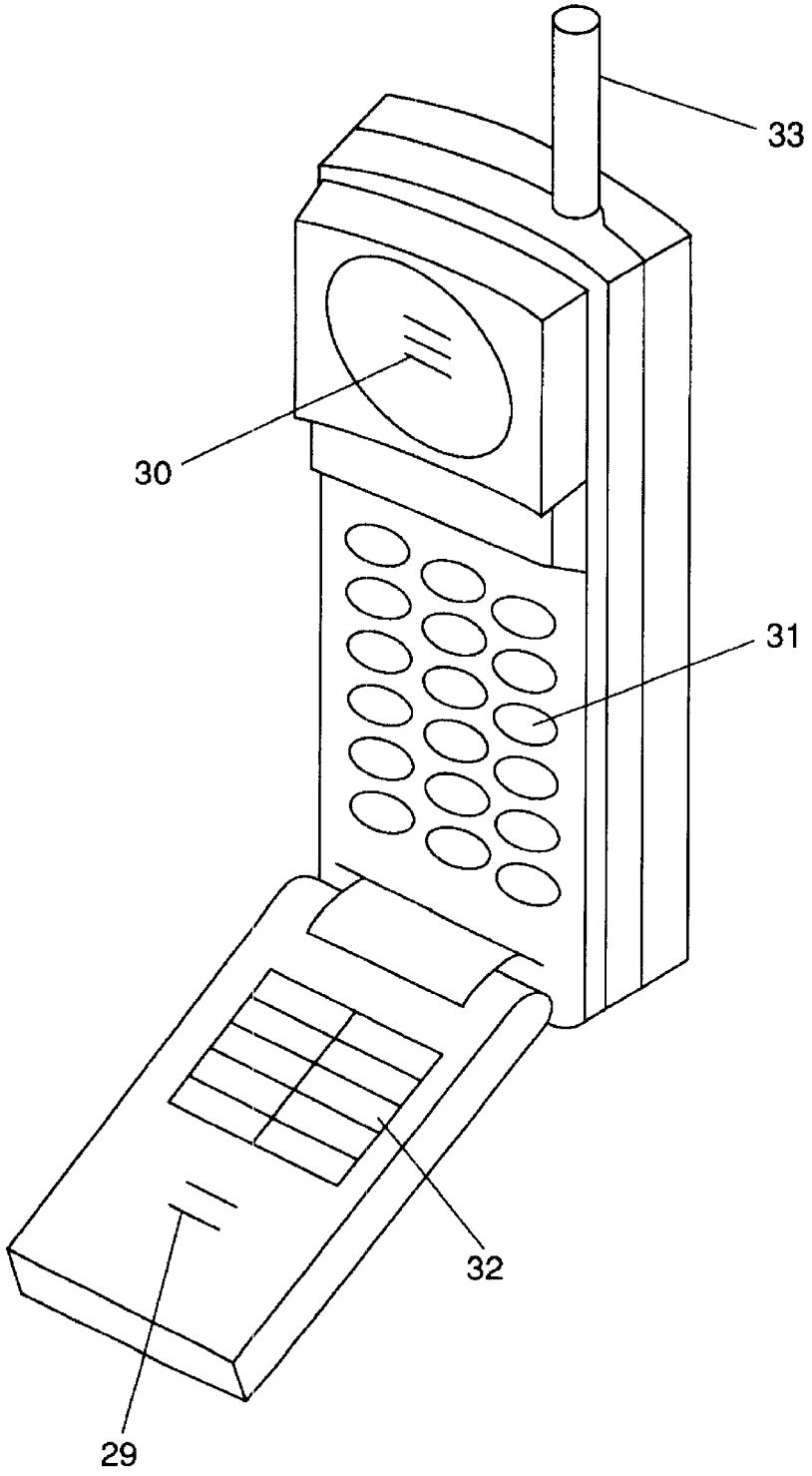
FIG. 12 is a perspective view showing a wireless terminal in embodiment 6 of the invention.
Figure 13:
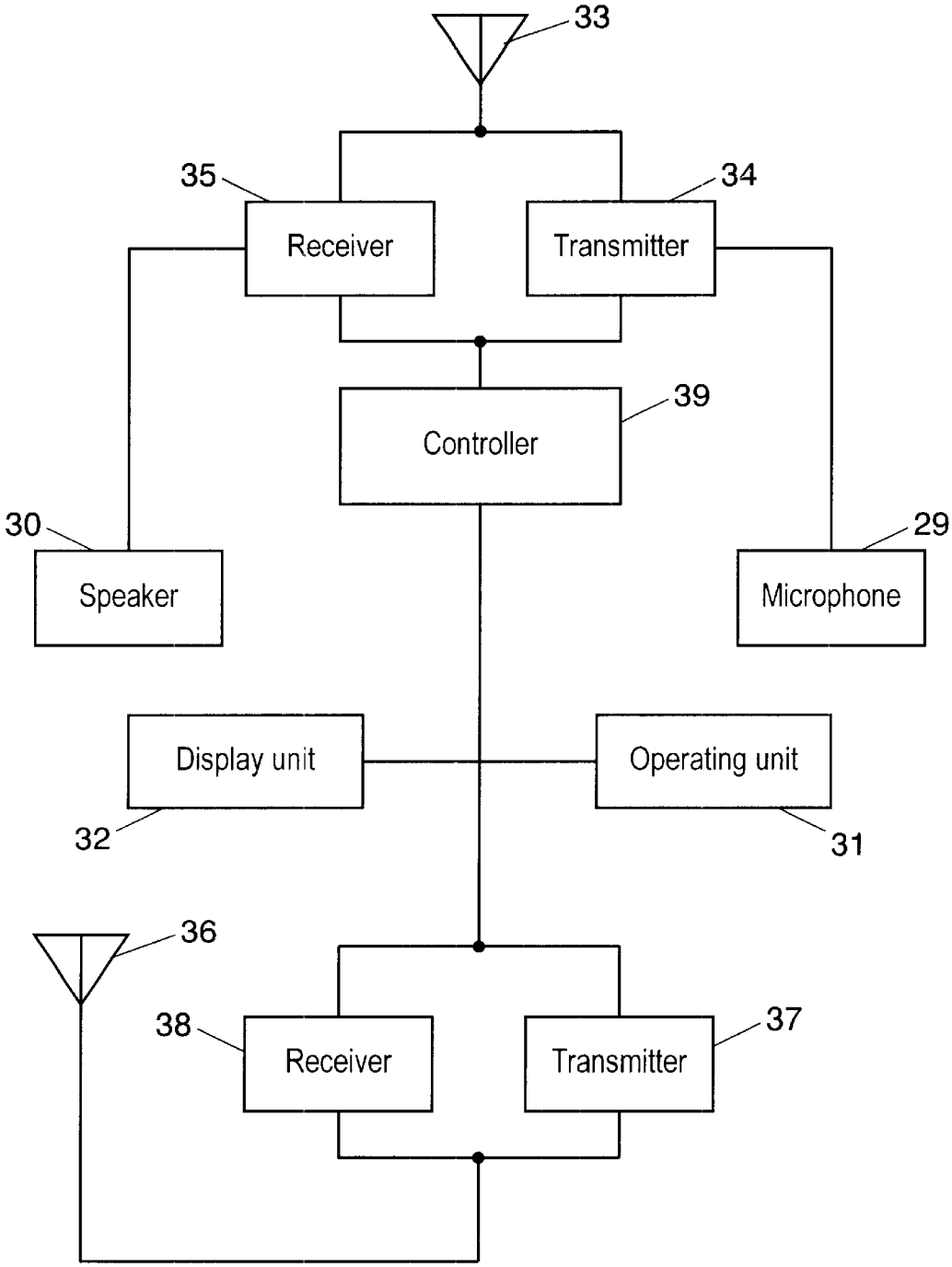
FIG. 13 is a block diagram showing a wireless terminal in embodiment 6 of the invention.

FIG. 12 and FIG. 13 are a perspective view and a block diagram, respectively, showing a wireless terminal incorporating a chip antenna of the present embodiment. Referring to FIG. 12, the wireless terminal includes microphone 29 and speaker 30. Operating portion 31 is made up of dial buttons and the like. Display 32 displays call-received information and received information. Antenna 33 performs signal transmission and reception of radio waves to and from a base station connected with public telephone lines and the like. Transmitting portion 34 shown in FIG. 13 modulates a voice signal from microphone 29 and convert it into a transmitted signal. The transmitted signal generated in transmitting portion 34 is radiated out into space by antenna 33. Receiving portion 35 demodulates a received signal through antenna 33 into a voice signal. The voice signal demodulated in receiving portion 35 is delivered from speaker 30 as a voice output. As chip antenna 36 in this embodiment, the same chip antenna as used in embodiment 1 is used. Antenna 36 performs transmission and reception of radio waves to and from stationary terminals such as desk-top computers and portable terminals such as mobile computers, not shown. Transmitting portion 37 converts a data signal into a rf signal and transmits the rf signal through antenna 36. Receiving.portion 38 converts a received signal through antenna 36 into a data signal. Controller 39 controls transmitting portion 34, receiving portion 35, operating portion 31, display 32, transmitting portion 37, and receiving portion 38.

Incidentally, though a helical antenna or whip antenna is used as antenna 33, while a chip antenna as shown in FIG. 1 and FIG. 2 is used as antenna 36 in the present embodiment, the chip antenna as shown in FIG. 1 and FIG. 2 may be used as both antenna 33 and antenna 36.

Further, in the wireless terminal shown in FIG. 13, such a wireless terminal may be configured in which antenna 36, transmitting portion 37, and receiving portion 38 are eliminated and antenna 33 is provided by a chip antenna shown in FIG. 1 and FIG. 2. An example of operation of the wireless terminal shown in FIG. 12 and FIG. 13 will be described below.

First, when a call is received, a call-received signal is sent from receiving portion 35 to controller 39 and controller 39, in response to the call-received signal, allows display 32 to display a predetermined character and the like thereon and, when a button instructing that the received signal should be accepted is depressed in operating portion 31, a signal is sent to controller 39 and controller 39 sets each unit of the wireless terminal at a call-accept mode. More specifically, a signal received by antenna 33 is demodulated to a voice signal in receiving portion 35 and the voice signal is delivered from speaker 30 as a voice output. Meanwhile, voice fed into microphone 29 is modulated thereby into a transmitted signal and the signal is passed through transmitting portion 34 and radiated out into space by antenna 33.

When originating a call, a signal instructing a call should be originated is fed into controller 39 from operating portion 31. When, in succession, a signal corresponding to a dialed telephone number is sent from operating portion 31 to controller 39, controller 39 allows the signal to be passed through transmitting portion 34 and radiated out into space by antenna 33. When the party on the other end has received the transmitted signal and a communication is established, a signal to that effect is received by antenna 33 and sent to controller 39 through receiving portion 35, whereupon controller 39 sets each unit of the wireless terminal at a call-initiate mode. More specifically, a signal received by antenna 33 is demodulated to a voice signal in receiving portion 35 and the voice signal is delivered from speaker 30 as a voice output, and meanwhile, voice fed into microphone 29 is modulated thereby into a transmitted signal and the signal is passed through transmitting portion 34 and radiated out into space.

<Embodiment 7>

Figure 14:
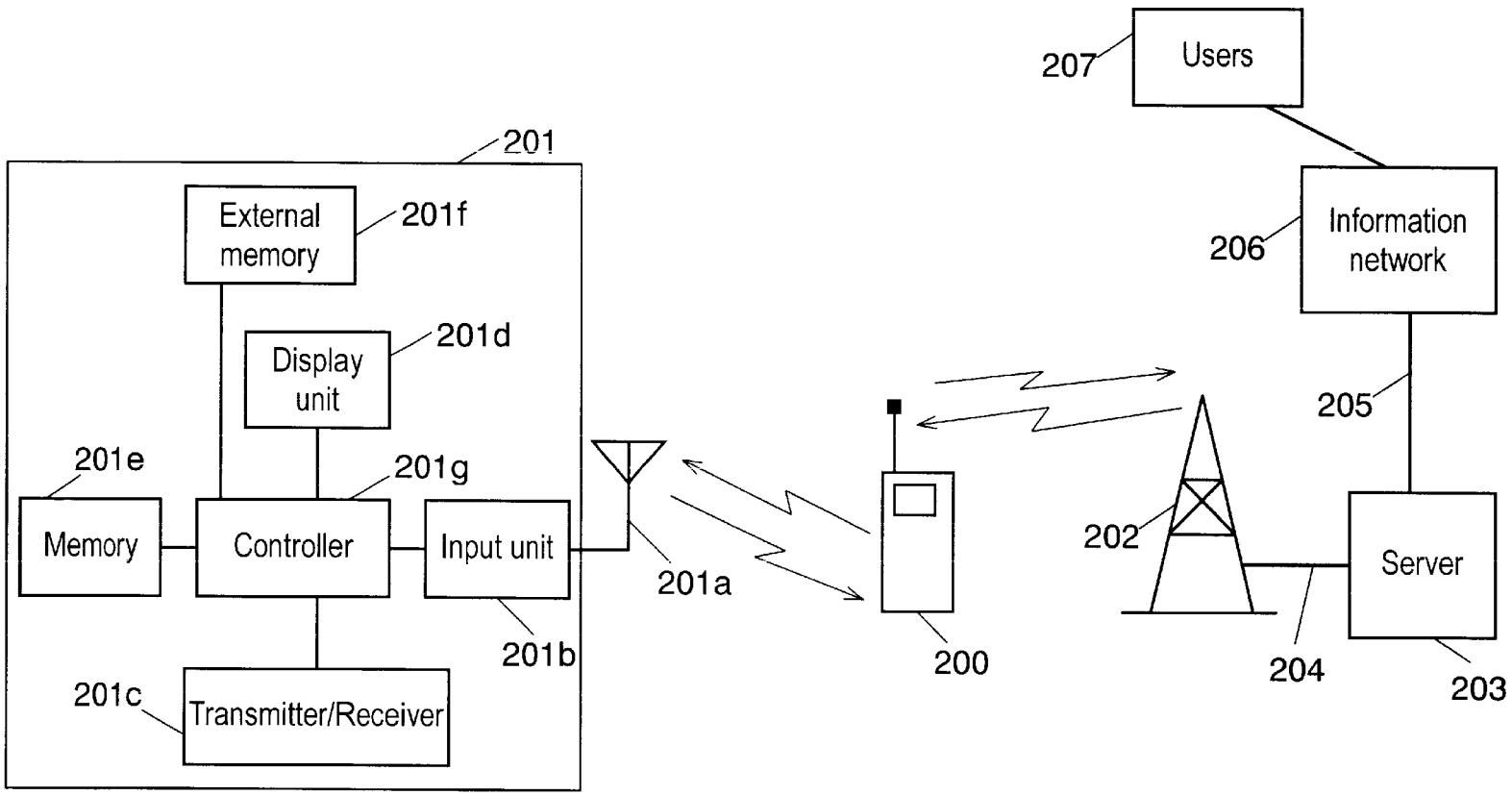
FIG. 14 is a block diagram showing a wireless communications system in embodiment 7 of the invention.

FIG. 14 is a block diagram showing a wireless communication system using the wireless terminal in embodiment 7 of the invention. Referring to FIG. 14, mobile terminal 201 transmits and receives data to and from wireless terminal 200 shown in FIG. 12 and FIG. 13. Base station 202 conducts communications with wireless terminal 200. Wireless terminal 200 conducts communication with base station 202 directly or, sometimes, conducts communication with base station 202 by way of low earth orbital (LEO) satellite. Server (preferably communication server) 203 is connected with base station 202 through public telephone line 204. Server 203 is connected with information network 206 such as the Internet through lines 205 such as public telephone lines and dedicated lines. Reference numeral 207 denotes users connected with information network 206. Here, "users" mean providers, specified or unspecified users, and the like.

Mobile terminal 201 is provided with antenna 201*a* for transmitting and receiving radio waves to and from wireless terminal 200. As antenna 201*a*, it is preferred that a chip antenna as shown in FIG. 1 and FIG. 2 be used. The chip antenna is incorporated in a box of mobile terminal 201 or in a communication card connected to mobile terminal 201. Transmit/receive portion 201*b* demodulates a received signal by antenna 201*a* to a received data signal and modulates transmitted data intended to be sent out by mobile terminal 201 to a transmitted signal. Input means 201*c* is made up of a keyboard, a handprint data-entry unit, a voice recognition data-entry unit, and the like and serves for entry of transmitted data and the like. Display 201 d is formed of an LCD display, a CRT display, an organic EL display, a plasma display, or the like and displays received data, transmitted data entered through input means 201*c*, and the like. Memory means 201*e* is formed of such memory as hard disk, floppy disk, DVD, magnet-optical disk, CD-R, and CD-RW, and stores and reads out received data. External memory means 201*f* is formed of ROM (read-only memory) such as CD-ROM or DVD-ROM for exclusively reading out of data. Control means 201*g* controls each part of mobile terminal 201.

An example of communicating method will be described below.

First, communication is established between wireless terminal 200 and server 203. Entered data from input means 201*c* of mobile terminal 201 or the like is sent to transmit/receive portion 201*b* as an input signal, the input signal is converted into a transmitted signal in transmit/receive portion 201*b*, and the signal is sent to wireless terminal 200 disposed in the neighborhood (for example, within a radius of 10 m) by antenna 201*x*. Wireless terminal 200 receives the transmitted signal through antenna 36 shown in FIG. 13 (not shown in FIG. 14) and the signal is converted into a data signal in receiving portion 38. The data signal is sent to transmitting portion 34 through controller 39 and converted into a transmitted signal in transmitting portion 34. The signal is sent out into space by antenna 33 and transmitted to user 207 connected to information network 206 through base station 202 and server 203. After all, the data entered in mobile terminal 201 is transmitted to user 207.

When data is conversely transmitted from user 207, the transmitted signal is sent to wireless terminal 200 through information network 206, server 203, and base station 202. When wireless terminal 200 has received the transmitted signal through antenna 33 as shown in FIG. 13, the signal is introduced into receiving portion 35 and it is determined whether the signal is voice or data. When it is a voice signal, a voice output is delivered from speaker 30 of wireless terminal 200, and when it is a data signal, the signal is sent to transmitting portion 37 through controller 39. The data signal is converted into a transmitted signal in transmitting portion 37 and radiated out into space by antenna 36. When the transmitted signal is received by antenna 201*a* of wireless terminal 201, the signal is demodulated to a data signal in transmit/receive portion 201*b* and controller 201*g* allows characters and the like to be displayed on display means 201*d* or stored in memory means 201*e* according to the data signal.

<Fabricating Method>

Method of fabrication of chip antennas of the present invention used in each of the above described preferred embodiments will be described below.

First, core body 11 is made by subjecting insulating material such as alumina to pressing or extrusion processing. Then, conductive film 12 is formed by plating, sputtering, or the like all over core body 11. When a buffer layer (carbon film, Ni—Cr film, film containing carbon, Ni alloy film, Ag, Sn, Cu, Ag-alloy, Sn alloy, Cu alloy) is provided in order to enhance the bonding strength between conductive film 12 and core body 11, conductive film 12 is provided by plating or the like after the buffer layer has been provided on core body 11 by vapor deposition, sintering, or the like.

Further, helical groove 13 is made in core body 11 having conductive film 12 formed thereon. Groove 13 is formed by laser processing or cutting work. Since the laser processing is very productive and favorable processing, detailed description of the laser processing will be given below.

Core body 11 is set on a rotating device and, while core body 11 is rotated, a laser beam is applied to core body 11, whereby both conductive film 12 and core body 11 are melted away and a helical groove is made. At this time, groove 13 is formed such that the longitudinal center of the antenna element portion (center of helical groove 13) is positioned in region B shown in FIG. 2. The types of laser used include YAG laser, eximer laser, and carbon oxide laser and the laser beam is focused by a lens or the like to be thrown on core body 11. The depth of groove 13 can be controlled by adjusting power of the laser and the width of groove 13 can be controlled by changing lenses for focusing the laser beam. Since absorption coefficient of a laser beam varies with such factors as the ingredients of conductive film 12, it is preferred that the type of laser (wavelength of laser beam) be suitably selected according to the ingredients of conductive film 12. Further, since it is difficult to make the width of groove 13 larger than a certain limit by laser processing, cutting work by the use of a grindstone or rubber may be employed when necessary.

After groove 13 has been made, protection member 14 is formed by applying protection member 14 to the interior of groove 13 and then drying it up or forming an electrolytically-deposited resin film by electrolytic deposition. Further, in order to prevent deterioration of antenna characteristics, a resin tube may be put on core body 11 to use the tube as protection member 14. At this time the length of the tube is set at such a length that will not overlap both end portions of core body 11 serving as terminal portions 15 and 16. When the resin tube has a heat-shrinking property, the tube after being mounted may be subjected to a heat treatment at a predetermined temperature so that the tube is tightly fixed onto the antenna element portion.

Although the product is completed through the above mentioned steps, it is sometimes practiced to deposit a nickel layer or solder layer over terminal portions 15 and 16, in particular, to obtain improved weather resistance or bonding strength. Such a nickel layer or solder layer is formed into protection member 14 by plating or the like and thereafter a semi-finished product is obtained.

When protection member 14 is formed by highly corrosion-resistive metallic film as shown in FIG. 6, a metallic film formed by plating or the like of gold, tin, or the like is provided on conductive film 12 as protection member 14 after groove 13 has been made.

As described above, according to the chip antenna, the wireless terminal using the chip antenna, and the method of fabricating the chip antenna of the present invention, a chip antenna that is simple in structure, provides good antenna characteristics, produces small variation in antenna characteristics between individual antennas, requires no circuit adjustments, is excellent in productivity, and is capable of being mounted on a circuit board, as well as a wireless terminal and a wireless communication system using the chip antenna can be provided.

What is claimed is:

1. A chip antenna comprising:

a core body formed in a cylinder shape;

a conductor having a helical shape mounted on a surface of said core body;

a protection member covering said conductor, said protection member being formed of at least one material out of a group consisting of gold, platinum, palladium, silver, tungsten, titanium, nickel, tin, copper, and an alloy including gold, platinum, palladium, silver, tungsten, titanium, nickel, tin, or copper and another element that is not gold, platinum, palladium, silver, tungsten, titanium, nickel, tin or copper; and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

2. A chip antenna comprising:

a core body formed in a cylinder shape;

a conductor having a helical shape mounted on a surface of said core body;

a resin protection member covering said conductor; and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

3. A chip antenna according to claim 2, wherein said resin protection member is formed by electrolytic deposition.

4. A chip antenna comprising:

a core body formed in a cylinder shape;

a conductor having a helical shape mounted on a surface of said core body;

a resin tube covering said conductor as a protection member; and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

5. A chip antenna according to claim 4, wherein said resin tube is a heat-shrinkable resin tube.

6. A chip antenna according to claim 4, wherein said conductor in the helical shape is a conductive film and a number of turns of said conductive film is an integer.

7. A chip antenna comprising:

a core body formed in a cylinder shape, said core body having a groove formed therein, wherein a line connecting a start point of the groove and an end point of the groove is virtually in parallel with center line of said core body;

a conductor having a helical shape mounted on a surface of said core body;

a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

8. A chip antenna comprising:

a core body formed in a cylinder shape;

a conductor having a helical shape mounted on a surface of said core body;

a terminal portion provided on said core body and connected to an end of said conductor, said terminal portion being a conductive film; and at least one of a protection layer protecting said terminal portion and a bonding layer facilitating electrical connection between said terminal portion and a pattern on a circuit board is provided at said terminal portion, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

9. A chip antenna according to claim 8, wherein said terminal portion is provided at both end portions of said core body and said conductor is electrically connected to said terminal portion at both of said end portions.

10. A chip antenna according to claim 8, wherein said terminal portion is provided at end portions of said core body, said terminal portion at a first end portion of said core body is electrically connected to an electronic circuit, and said terminal portion at a second end portion is not connected to the electronic circuit.

11. A chip antenna according to claim 8, wherein said terminal portion is provided at end portions of said core body, said terminal portion at each of said end portions is connected with a pattern on a circuit board.

12. A chip antenna comprising:

a core body formed in a cylinder shape;

a conductor having a helical shape mounted on a surface of said core body;

a terminal portion provided on entire peripheral surfaces of both end portions of said core body and connected with an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

13. A chip antenna according to claim 12, wherein entire end faces at both end portions of said core body or center portions of said end faces lack a conductive surface.

14. A chip antenna comprising:

a core body formed in a cylinder shape, wherein a cross-sectional size of both end portions of said core body is larger than a cross-sectional size of a center portion of said core body in a stepped manner;

a conductor having a helical shape mounted on a surface of a center portion of said core body; and a terminal portion provided on both of said end portions of said core body and connected with an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

15. A chip antenna comprising:

a core body formed in a cylinder shape;

a conductor having a helical shape mounted on a surface of said core body; and a terminal portion provided on said core body and connected with an end of said conductor, said terminal portion comprising a pair of conductive caps located on both end portions of said core body, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

16. A chip antenna comprising:

a core body formed in a cylinder shape;

a conductor having a helical shape mounted on a surface of said core body, said conductor being a conductive film;

a terminal portion provided on said core body and connected to an end of said conductor; and a bonding film provided as a layer over said terminal portion and said conductive film, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

17. A chip antenna according claim 16, wherein said bonding film is made of at least one of tin, tin alloy excluding tin-lead alloy, gold, and gold alloy.

18. A chip antenna comprising:

a core body formed in a cylinder shape;

a conductor having a helical shape mounted on a surface of said core body, wherein a position of a center in a longitudinal direction of said conductor is located within a range of 0.3×L from both end faces of said core body, where L represents a total length of said chip antenna; and a terminal portion provided on said core body and connected with an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

19. A chip antenna comprising:

a core body formed in a cylinder shape;

a conductor having a helical shape mounted on a surface of said core body, wherein a position of a center in a longitudinal direction of said conductor is located within a range of 0.3×L to 0.7×L from both end faces of said core body, where L represents a total length of said chip antenna; and a terminal portion provided on said core body and connected with an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

20. A chip antenna according claim 19, wherein said conductor is formed from a conductive wire.

21. A wireless terminal for communicating with a communication apparatus, said wireless terminal comprising:

a chip antenna being operable to transmit and receive a signal to and from the communication apparatus, said chip antenna comprising a core body formed in a cylinder shape, a conductor having a helical shape mounted on a surface of said core body, a terminal portion provided on entire peripheral surfaces of both end portions of said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less; and a transmit and receive portion coupled to said chip antenna.

22. A wireless communication system comprising:

a wireless terminal including a chip antenna, said chip antenna comprising a core body formed in a cylinder shape, a conductor having a helical shape mounted on a surface of said core body, a terminal portion provided on entire peripheral surfaces of both end portions of said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less;

a mobile terminal being operable to transmit and receive data to and from said wireless terminal;

a base station being operable to transmit and receive a data or voice signal to and from said wireless terminal; and a server connected to said base station via a communication line.

23. A method for manufacturing a chip antenna comprising a core body formed in a cylinder shape, a conductive film formed on a surface of the core body, a groove cut into a peripheral surface of the core body in a helical shape to form the conductive film into a helical shape, and a protection member protecting the conductive film, said method comprising:

producing the core body from a plate-shaped insulating material by pressing or extrusion processing;

after said producing of the core body, cutting the core body such that a cross-section in a longitudinal direction of a center portion of the core body is made smaller than that of both end portions of the core body in a stepped manner;

after said cutting of the core body, producing the conductive film;

after said producing of the conductive film, cutting a groove having a helical shape in a surface of the center portion of the core body; and after said cutting of the groove, producing the protection member on a surface of the core body.

24. A method according to claim 23, wherein said producing of the protection member includes producing the protection member by plating a metallic film that is highly resistive to corrosion, the metallic film including gold and tin.

25. A method according to claim 23, further comprising after said cutting of the core body, producing a buffer layer on a surface of the core body by vapor deposition or coating and sintering.

26. A method according to claim 23, further comprising after said producing of the protection member, producing a protection layer by plating one of a nickel layer and a solder layer on both of the end portions of the core body.

27. A chip antenna comprising:

a core body formed in a cylinder shape;

a conductor having a helical shape mounted on a surface of said core body, wherein said conductor is a conductive film;

a buffer layer provided between said conductive film and said core body, a terminal portion provided on said core body and connected to an end of said conductor;

a bonding film provided in a layer over said terminal portion and said conductive film, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less.

28. A chip antenna according to claim 27, wherein said bonding film is made of at least one of tin, tin alloy excluding tin-lead alloy, gold, and gold alloy.

29. A wireless terminal for communicating with a communication apparatus, said wireless terminal comprising:

a chip antenna being operable to transmit and receive a signal to and from the communication apparatus, said chip antenna comprising a core body formed in a cylinder shape, a conductor having a helical shape mounted on a surface of said core body, wherein a position of a center in a longitudinal direction of said conductor is located within a range of 0.3×L from both end faces of said core body, where L represents a total length of said chip antenna, and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less; and a transmit and receive portion coupled to said chip antenna.

30. A wireless communication system comprising:

a wireless terminal including a chip antenna, said chip antenna comprising a core body formed in a cylinder shape, a conductor having a helical shape mounted on a surface of said core body, wherein a position of a center in a longitudinal direction of said conductor is located within a range of 0.3×L from both end faces of said core body, where L represents a total length of said chip antenna, and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less;

a mobile terminal being operable to transmit and receive data to and from said wireless terminal;

a base station being operable to transmit and receive a data or voice signal to and from said wireless terminal; and a server connected to said base station via a communication line.

31. A wireless terminal for communicating with communication apparatus, said wireless terminal comprising:

a chip antenna being operable to transmit and receive a signal to and from the communication apparatus, said chip antenna comprising a core body formed in a cylinder shape, a conductor having a helical shape mounted on a surface of said core body, wherein a position of a center in a longitudinal direction of said conductor is located within a range of 0.3×L to 0.7×L from both end faces of said core body, where L represents a total length of said chip antenna, and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less; and a transmit and receive portion coupled to said chip antenna.

32. A wireless communication system comprising:

a wireless terminal including a chip antenna, said chip antenna comprising a core body formed in a cylinder shape, a conductor having a helical shape mounted on a surface of said core body, wherein a position of a center in a longitudinal direction of said conductor is located within a range of 0.3×L to 0.7×L from both end faces of said core body, where L represents a total length of said chip antenna, and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less;

a mobile terminal being operable to transmit and receive data to and from said wireless terminal;

a base station being operable to transmit and receive a data or voice signal to and from said wireless terminal; and a server connected to said base station via a communication line.

33. A wireless terminal for communication with a communication apparatus, said wireless terminal comprising:

an chip antenna being operable to transmit and receive a signal to and from the communication apparatus, said chip antenna comprising a core body formed in a cylinder shape; a conductor having a helical shape mounted on a surface of said core body, a resin tube covering said conductor as a protection member, and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less;

a transmit and receive portion coupled to said chip antenna.

34. A wireless communication system comprising:

a wireless terminal including a chip antenna, said chip antenna comprising a core body formed in a cylinder shape, a conductor having a helical shape mounted on a surface of said core body, a resin tube covering said conductor as a protection member; and a terminal portion provided on said core body and connected to an end of said conductor, wherein a width of said core body is within a range of 0.5–5 mm, a depth of said core body is within a range of 0.5–5 mm, a length of said core body is within a range of 4–40 mm, an intrinsic volume resistance of said core body is $10^{13}\Omega\cdot m$ or above, a relative dielectric constant of said core body is 40 or less;

a mobile terminal being operable to transmit and receive data to and from said wireless terminal;

a base station being operable to transmit and receive a data or voice signal to and from said wireless terminal; and a server connected to said base station via a communication line.

* * * * *